US009513078B1

(12) United States Patent
Fulton et al.

(10) Patent No.: US 9,513,078 B1
(45) Date of Patent: Dec. 6, 2016

(54) QUICK MOUNT FIREARM BARREL ACCESSORY

(71) Applicant: PRECISION TOOLING PRODUCTS, LLC, Mayfield, KY (US)

(72) Inventors: Joshua S. Fulton, Mayfield, KY (US); Timothy C. Fulton, Mayfield, KY (US)

(73) Assignee: Precision Tooling Products, LLC, Mayfield, KY (US)

( * ) Notice: Subject to any disclaimer, the term of this patent is extended or adjusted under 35 U.S.C. 154(b) by 0 days.

(21) Appl. No.: 15/156,451

(22) Filed: May 17, 2016

(51) Int. Cl.
*F41A 21/32* (2006.01)

(52) U.S. Cl.
CPC ..... *F41A 21/325* (2013.01)

(58) Field of Classification Search
CPC ..... F41A 21/00; F41A 21/30; F41A 21/32; F41A 21/34; F41A 21/48; F41A 21/481; F41A 21/484; F41C 27/18
See application file for complete search history.

(56) References Cited

U.S. PATENT DOCUMENTS 968,583 A * 8/1910 Michaud ..... F41A 21/40 42/79
4,893,426 A * 1/1990 Bixler ..... F16B 7/20 403/299
5,271,312 A * 12/1993 Lishness ..... F41A 21/484 42/76.01
5,559,302 A * 9/1996 Latka ..... F41A 21/325 89/14.05
7,891,282 B1 * 2/2011 DeGroat ..... F41A 21/325 181/223
8,511,425 B2 8/2013 LaRue
8,714,300 B2 * 5/2014 Johansen ..... F41A 21/30 181/223
8,910,746 B1 * 12/2014 McKenzie ..... F41A 21/30 181/223
8,997,621 B1 * 4/2015 Dater ..... F41A 21/325 89/14.3
9,057,576 B2 * 6/2015 Barrett ..... F41A 21/481
9,121,656 B1 * 9/2015 McKenzie ..... F41A 21/30
(Continued)

OTHER PUBLICATIONS

Quickstand Silencer, available at http://www.gem-tech.com/store/pc/QUICKSAND-p122.htm (last accessed May 11, 2016).

*Primary Examiner* — Bret Hayes
*Assistant Examiner* — Derrick Morgan
(74) *Attorney, Agent, or Firm* — Shane V. Cortesi

(57) ABSTRACT

A firearm barrel accessory that quick connects and disconnects to a firearm barrel by rotating is described. The accessory may be a firearm suppressor with a silencer barrel, a mount retention ring located inside the silencer barrel that includes longitudinal grooves that lead to circumferential grooves that have a first radial side and a second radial side. The firearm barrel is attached to a muzzle break that may include a plurality of lugs that fit into longitudinal grooves. After placement in the longitudinal grooves, the silencer barrel and mount retention ring are rotated/twisted about the silencer barrel longitudinal axis so that the circumferential grooves move relative to the lugs until the lugs contact the second radial side, at which point the mount retention ring ceases to rotate while the silencer barrel continues to rotate. A ratchet retention ring may exert tension on the mount retention ring in the rearward direction.

18 Claims, 19 Drawing Sheets

(56) References Cited

U.S. PATENT DOCUMENTS

| | | | | |
|---|---|---|---|---|
| 2010/0282056 | A1* | 11/2010 | Hung | F41A 21/34 89/14.2 |
| 2011/0197487 | A1* | 8/2011 | Humston | F41A 21/34 42/1.06 |
| 2012/0180624 | A1 | 7/2012 | Troy | |
| 2015/0184960 | A1* | 7/2015 | Monveldt | F41A 5/26 89/193 |
| 2015/0198403 | A1* | 7/2015 | Bentley | F41A 21/484 42/75.02 |
| 2015/0253098 | A1* | 9/2015 | Russell | F41A 21/325 89/14.4 |
| 2015/0377577 | A1* | 12/2015 | Pappas | F41A 21/34 89/14.2 |
| 2016/0102935 | A1* | 4/2016 | Young | F41A 21/325 42/76.01 |

* cited by examiner

QUICK MOUNT FIREARM BARREL ACCESSORY

BACKGROUND

Technical Field

The present invention relates to firearm barrel accessories such as suppressors, also known as silencers.

Background of the Invention

Firearm suppressors, commonly referred to as gun silencers are known in the art. In some prior art devices firearm silencers may be threaded to the gun barrel.

U.S. Pat. No. 5,433,133 (the '133 patent) teaches a gun barrel coupling member for attaching and detaching a firearm accessory, namely a flash hider, to the front end of the gun barrel of the firearm. The '133 patent teaches a gun barrel with radially spaced lugs that fit inside notches in a coupling member. The coupling member is, in turn, attach to the flash hider via threads. A pin is inserted in the coupling member to limit rotation of the coupling member on the end of the gun barrel. Operation of the pin is not described in the '133 patent. Without being bound to any particular theory, it is believed that the flash hider may be prone to detaching from the coupling member over time due to vibration.

BRIEF SUMMARY

The present disclosure provides a firearm barrel accessory system as described herein. Optionally, the firearm barrel accessory system is in the form a firearm suppressor system comprising:

a) a firearm comprising a gun barrel configured to fire ammunition;

b) a muzzle break attached to the gun barrel and comprising a muzzle break interior receiving the gun barrel, a muzzle break rear end facing the firearm and comprising a muzzle break rear opening leading to the muzzle break interior, a muzzle break forward end comprising a muzzle break forward opening leading to the muzzle break interior and configured to eject the ammunition, a muzzle break length extending from the muzzle break forward end to the muzzle break rear end, a muzzle break width perpendicular to the muzzle break length, a muzzle break circumference perpendicular to the muzzle break length, and a plurality of lugs spaced about the muzzle break circumference;

c) a mount retention ring configured to receive the muzzle break and comprising an interior wall forming a mount retention ring interior, a mount retention ring exterior, a mount retention ring forward end comprising a mount retention ring forward opening leading to the mount retention ring interior, a mount retention ring rear end comprising a mount retention ring rear opening leading to the mount retention ring interior, a mount retention ring length extending from the mount retention ring forward end to the mount retention ring rear end, a mount retention ring circumference perpendicular to the mount retention ring length, a plurality of longitudinal grooves located in the interior wall, each longitudinal groove having a longitudinal groove forward end, a longitudinal groove rear end, a longitudinal groove length extending from the longitudinal groove forward end to the longitudinal groove rear end, the longitudinal groove length extending partially about the mount retention ring length, each of the longitudinal grooves configured to allow a lug of the plurality of lugs to pass therethrough, a plurality of circumferential grooves, each of the plurality of circumferential grooves located in the interior wall at the forward end of a longitudinal groove and extending partially about the mount retention ring circumference, each of the plurality of circumferential grooves configured to receive a lug from a longitudinal groove and having a circumferential groove rear side defined by a rear ledge located in the interior wall, a circumferential groove forward side defined by a forward ledge in the interior wall, the forward ledge located forwardly relative to the rear ledge in the mount retention ring interior, a circumferential groove thickness extending from the circumferential groove forward side to the circumferential groove rear side, a circumferential groove first radial side located adjacent to a longitudinal groove, a circumferential groove second radial side opposite the first radial side, a circumferential groove length extending from the first radial side to the second radial side and generally parallel to the mount retention ring circumference and generally perpendicular to the longitudinal groove lengths, a plurality of indentations, each indentation located in a rear ledge adjacent to a second radial side of a circumferential groove and extending toward the mount retention ring rear end, and a plurality of mount retention ring threads spaced about the exterior of the mount retention ring; and d) a silencer barrel comprising a silencer barrel interior comprising the mount retention ring, a silencer barrel exterior wall, a silencer barrel front end comprising a silencer barrel forward opening leading to the silencer barrel interior and configured to fire the ammunition, a silencer barrel rear end comprising a silencer barrel rear opening leading to the silencer barrel interior, a silencer barrel length extending from the silencer barrel front end to the silencer barrel rear end, and a plurality of silencer barrel threads located in the silencer barrel interior and mating with the mount retention ring threads, wherein, when the ammunition is fired from the firearm, the ammunition is configured to pass from the gun barrel, through the muzzle break interior, through the mount retention ring interior, and out the silencer barrel forward opening, and the silencer barrel interior is configured to dampen noise emanating from the firearm suppressor system, wherein the silencer barrel comprises a longitudinal axis parallel to the silencer barrel length and passing through the silencer barrel interior, wherein rotating the silencer barrel exterior wall a first rotation about the longitudinal axis relative to the muzzle break and the gun barrel when each lug is located in a circumferential groove and adjacent to the first radial side and adjacent to a rear ledge is configured to rotate the mount retention ring so that each second radial side moves toward and contacts a lug, and further wherein rotating the silencer barrel exterior wall a second rotation in the same direction as the first rotation about the longitudinal axis relative to the muzzle break and the gun barrel when each lug is located in a circumferential groove and contacting the second radial side is configured to move the mount retention ring threads about the silencer barrel threads and to move the mount retention ring longitudinally within the silencer barrel interior toward the silencer barrel front end so that each indentation approaches one of the lugs.

Optionally, the mount retention ring threads are not configured to move about the silencer barrel threads during the first rotation and the mount retention ring is configured to remain a fixed distance from the silencer barrel front end during the first rotation. Optionally, the spacing between the lugs along the muzzle break circumference is substantially equal to the spacing between the longitudinal grooves about the mount retention ring circumference. Optionally, the system further comprises at least one retention spring exerting tension on the mount retention ring in the rear direction.

Optionally, the at least one retention spring comprises a forward end connected to a ledge within the silencer barrel interior and a rear end connected to a forward end of a pin, and further wherein the pin further comprises a rear end connected to the mount retention ring forward end. Optionally, the forward end of the pin is attached to a forward end of a ratchet retention ring, and further wherein the ratchet retention ring comprises a rear end comprises a plurality of teeth spaced about a circumference of the ratchet retention ring and configured to mate with a plurality of forward end grooves spaced about the circumference of the mount retention ring forward end, each of the plurality of forward end grooves separated by a ridge. Optionally, the silencer barrel interior comprises a plurality of baffles forwardly disposed relative to the silencer barrel threads. Optionally, the muzzle break comprises a tapered portion located forwardly relative to the lugs and configured to contact a tapered portion of an interior wall of the silencer barrel when the plurality of lugs are located in the plurality of circumferential grooves and further wherein the contact between the tapered portion of the muzzle break and the tapered portion of the interior wall is configured to prevent the muzzle break from moving toward the silencer barrel front end. Optionally, the forward ledges are configured to prevent the plurality of lugs from moving forwardly within the silencer barrel interior beyond the forward ledges. Optionally, the silencer barrel is configured to be locked to the muzzle break with a user using one hand to rotate the silencer barrel exterior wall. Optionally, all components for attaching the muzzle break to the silencer barrel are located in the silencer barrel interior when the silencer barrel is locked to the muzzle break. Optionally, the silencer barrel further comprises a tube locking ring comprising tube locking ring threads mating with the silencer barrel threads, the tube locking ring forming the rear end of the silencer barrel and configured to prevent the mount retention ring threads from moving rearwardly beyond the silencer barrel threads, a taper mount cap comprising the silencer barrel threads, and a sleeve forming the forward end of the silencer barrel. Optionally, the muzzle break further comprises plurality of gas ports configured to reduce flash and further wherein the lugs are located rearwardly relative to the gas ports. Optionally, each lug comprises a lug width generally perpendicular to the muzzle break circumference, wherein each of the longitudinal grooves comprises a longitudinal groove width generally parallel to the mount retention ring circumference, each indentation comprises an indentation width generally parallel to the mount retention ring circumference, wherein the width of each respective lug is approximately equal in size to the width of the longitudinal groove that the lug passes through, and further wherein the width of each respective lug is less than the width of the circumferential groove that the lug passes through. Optionally, the lugs are generally pyramidal in shape. Optionally, the lugs each have a lug length generally parallel to the muzzle break length, wherein the indentations each have an indentation length generally parallel to the mount retention ring length, and further wherein the length of each respective lug is greater than the length of the indentation that the lug is moved into. Optionally, the circumferential grooves are generally perpendicular to the longitudinal grooves. Optionally, each of the plurality of lugs have the same shape.

The present disclosure also provides a method of mating a suppressor to a firearm, the method comprising the steps of: a) providing the system; b) inserting the lugs through the longitudinal grooves and into the circumferential grooves adjacent to the circumferential groove first radial ends; c) rotating the silencer barrel exterior wall the first rotation relative to the muzzle break so that the lugs move towards and contact the circumferential groove second radial ends; and d) rotating the silencer barrel exterior wall the second rotation relative to the muzzle break so that the lugs cause the mount retention ring threads to move along the silencer barrel threads and cause the mount retention ring to move forwardly within the barrel sleeve interior so that the indentations move forwardly within the silencer barrel interior toward the lugs.

In still further embodiments, the present disclosure provides a firearm suppressor system comprising:

a) a firearm comprising a gun barrel configured to fire ammunition;

b) a muzzle break attached to the gun barrel and comprising a muzzle break interior receiving the gun barrel, a muzzle break rear end facing the firearm and comprising a muzzle break rear opening leading to the muzzle break interior, a muzzle break forward end comprising a muzzle break forward opening leading to the muzzle break interior and configured to eject the ammunition, a muzzle break length extending from the muzzle break forward end to the muzzle break rear end, a muzzle break width perpendicular to the muzzle break length, and a muzzle break circumference perpendicular to the muzzle break length; and c) a silencer barrel configured to removably lock to the muzzle break and comprising a silencer barrel interior comprising the mount retention ring, a silencer barrel front end comprising a silencer barrel forward opening leading to the silencer barrel interior and configured to fire the ammunition, a silencer barrel rear end comprising a silencer barrel rear opening leading to the silencer barrel interior, a silencer barrel length extending from the silencer barrel front end to the silencer barrel rear end, and a longitudinal axis parallel to the silencer barrel length and passing through the silencer barrel interior, the silencer barrel comprised of:

i) a tube locking ring forming the rear end of the silencer barrel and having a tube locking ring rear end comprising the silencer barrel rear opening and a tube locking ring forward end comprising a plurality of tube locking ring threads;

ii) a mount retention ring comprising a circumference and at least one lock configured to removably lock to the muzzle break, the mount retention ring comprising a forward end comprising a plurality of mount retention ring threads disposed forwardly within the silencer barrel interior relative to the tube locking ring threads and a plurality of grooves spaced about the circumference of the forward end of the mount retention ring;

iii) a ratchet retention ring comprising a forward end facing the forward end of the silencer barrel and a rear end facing the plurality of grooves and comprising a plurality of teeth configured to mate with the plurality of grooves;

iv) a taper mount cap disposed forwardly relative to the tube locking ring, the taper mount cap comprising an interior comprising the mount retention ring, the ratchet retention ring, a taper mount cap ledge disposed forwardly relative to the mount retention ring and the ratchet retention ring within the taper mount cap interior and a plurality of taper mount cap threads configured to mate with the tube locking ring threads and the mount retention ring threads, the taper mount cap ledge comprising a taper mount cap ledge circumference and a plurality of spring recesses spaced about the taper mount cap ledge circumference;

v) a plurality of retention springs seated inside the plurality of spring recesses, each spring having a forward end and a rear end; and vi) a plurality of retention pins located inside the taper mount cap interior, each retention pin having a forward end attached to a rear end of a retention spring and a rear end attached to the ratchet retention ring, wherein the taper mount cap, the ratchet retention ring and the tube locking ring are rotatable along a silencer barrel longitudinal axis relative to the mount retention ring, wherein rotation of the taper mount cap, the ratchet retention ring and the tube locking ring relative to the mount retention ring causes the mount retention ring to move along the taper mount cap threads and the silencer barrel length and causes the teeth to move about the mount retention ring grooves, wherein the retention pins exert tension on the ratchet retention ring in the rear direction, wherein, when the ammunition is fired from the firearm, the ammunition is configured to pass from the gun barrel, through the muzzle break interior, through the tube locking ring, through the taper mount cap interior and out the silencer barrel forward opening, and the silencer barrel interior is configured to dampen noise emanating from the firearm suppressor system.

Optionally, the mount retention ring lock comprises at least one mount retention ring groove located in the mount retention ring interior and configured to mate with a muzzle lug located on the muzzle.

The firearm suppressor system may include any of the embodiments of the prior embodiment. For example, optionally the at least one groove comprises at least one longitudinal groove extending partially about the mount retention groove length and at least one circumferential groove connected to the at least one longitudinal groove and extending partially about the mount retention groove circumference. Optionally, the silencer barrel interior comprises a plurality of baffles disposed forwardly relative to the taper mount cap. Optionally, rotation of the taper mount cap, the ratchet retention ring and the tube locking ring relative to the mount retention ring causes the mount retention ring to move along the taper mount cap threads and to move forwardly the silencer barrel length.

BRIEF DESCRIPTION OF THE DRAWINGS

in FIG. 1A, the muzzle break is about to be inserted into mount retention ring interior.

in FIG. 1B the muzzle break is inserted into the mount retention ring interior.

in FIG. 4A, the muzzle break is about to be inserted into mount retention ring interior.

in FIG. 4B, the muzzle break is about to be inserted into mount retention ring interior.

in FIG. 4C, the muzzle break is about to be inserted into mount retention ring interior and the tapered mating surfaces on the muzzle break and the silencer barrel interior wall (more particularly in the taper mount cap) are apparent.

in FIG. 4D, the muzzle break is about to be inserted into mount retention ring interior, and the arrows show how the lugs are moved through the longitudinal grooves and into the circumferential grooves, then along the circumferential grooves and then towards the indentations.

in FIG. 8A, the muzzle break has been inserted into the mount retention ring, the lugs have travelled through the longitudinal grooves, and the taper of the muzzle break has contacted the taper of the interior wall of the silencer barrel.

in FIG. 9A, as compared to FIG. 8A, the silencer barrel exterior wall and the mount retention ring have been rotated 60 degrees counter-clockwise relative to the muzzle break.

as shown in FIG. 9C, the lug is not in contact with the indentation.

in FIG. 10A, as compared to FIG. 9A, the silencer barrel exterior wall has been rotated 60 degrees counter-clockwise relative to the muzzle break and the mount retention ring, and the mount retention ring has moved forwardly within the silencer barrel interior relative to FIG. 9A so that the lug contacts the indentation.

as shown in FIG. 11C, the indentation has partially moved towards the lug and the and the mount retention ring has moved forwardly within the silencer barrel interior relative to FIG. 8A and the teeth of the ratchet retention ring are located on the ridges adjacent to the rear grooves of the mount retention ring.

DETAILED DESCRIPTION

Figure 1:
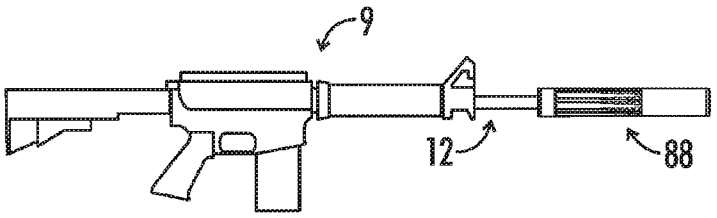
FIG. 1 illustrates an assembled, side elevation view of a firearm suppressor system of one embodiment of the present invention.
Figure 1A:
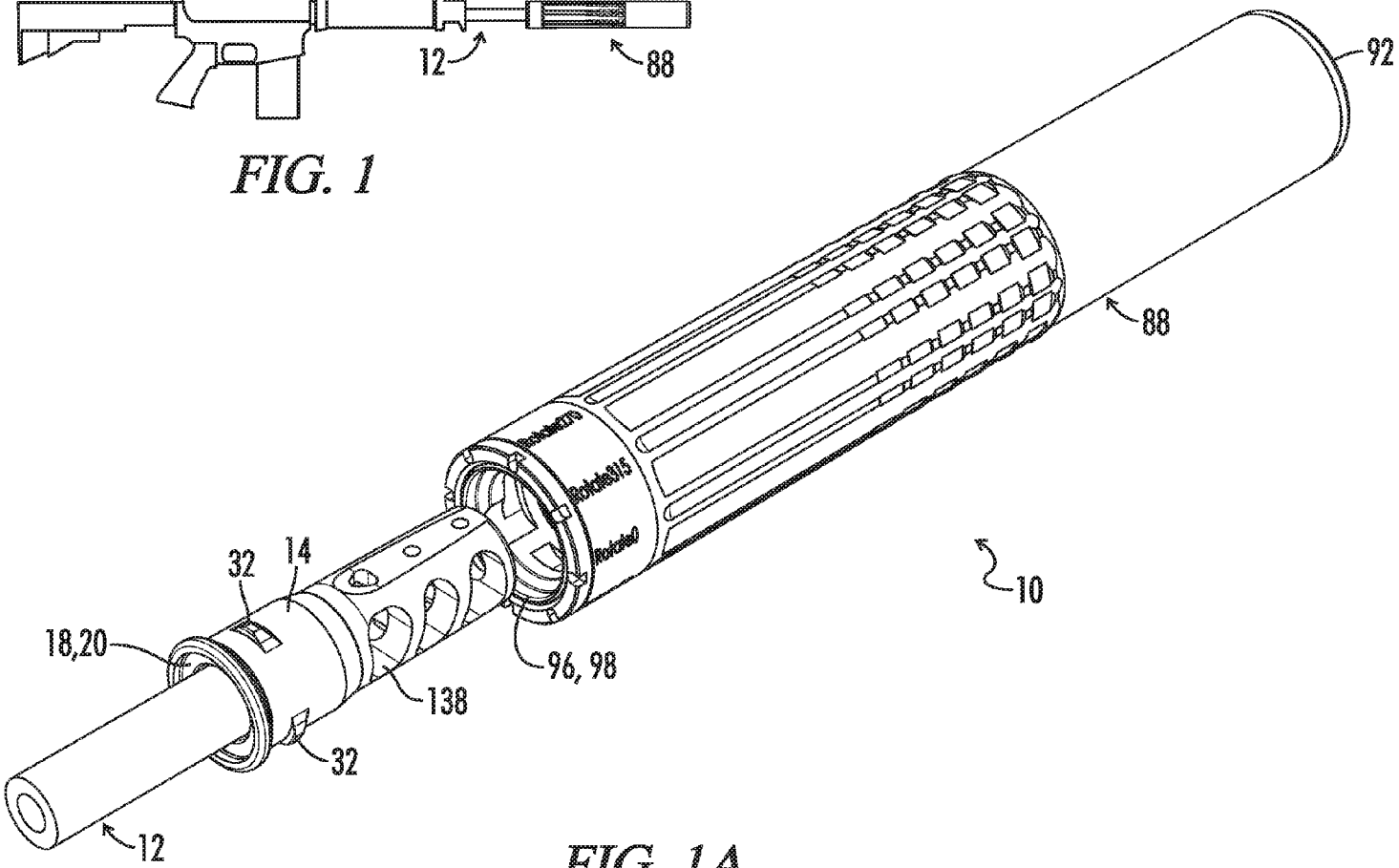
FIG. 1A illustrates a partially exploded, side perspective view of the firearm suppressor system of FIG. 1 without the firearm.
Figure 1B:
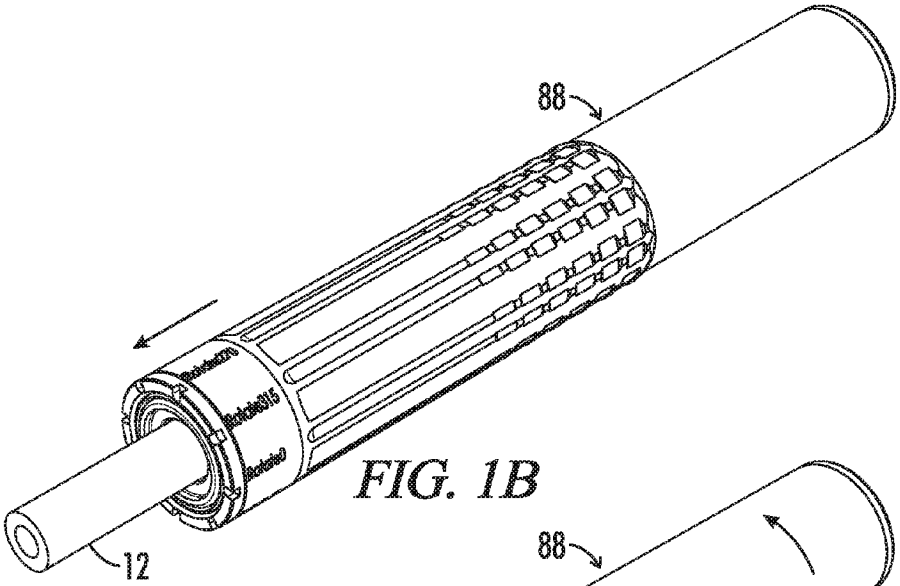
FIG. 1B illustrates an assembled, side perspective view of the firearm suppressor system of FIG. 1A.

With reference to FIGS. 1-11 the present disclosure provides a firearm barrel accessory system designated by the numeral 10. In the drawings, not all reference numbers are included in each drawing for the sake of clarity. In addition, although the firearm barrel accessory system 10 is preferably a firearm suppressor —otherwise known as a silencer— other firearm barrel accessories may use the attachment described herein.

Referring further to FIGS. 1-11, the firearm barrel accessory system 10 includes a firearm 9 comprising a gun barrel 12 configured to fire ammunition. In addition to the gun barrel 12, the firearm 9 includes one or more components typically found in a firearm 9 including those now known or later developed such as a trigger, an ammunition magazine, and a scope.

The firearm barrel accessory system 10 further includes a muzzle break 14 attached (preferably removably attached) to the gun barrel 12 and comprising a muzzle break interior 16 receiving the gun barrel 12, a muzzle break rear end 18 facing the firearm 9 and comprising a muzzle break rear opening 20 leading to the muzzle break interior 16, a muzzle break forward end 22 comprising a muzzle break forward opening 24 leading to the muzzle break interior 16 and configured to eject the ammunition, a muzzle break length 26 extending from the muzzle break forward end 22 to the muzzle break rear end 18, a muzzle break width 28 perpendicular to the muzzle break length 26, and a muzzle break circumference 30 perpendicular to the muzzle break length 26. The muzzle break 14 preferably includes a plurality of lugs 32 that are preferably unevenly spaced about the muzzle break circumference 30 (it being understood that evenly spaced would mean that one lug would be at 0 degrees, a second lug would be at 120 degrees, and a third lug would be at 240 degrees if the muzzle break included three lugs).

Figure 4A:
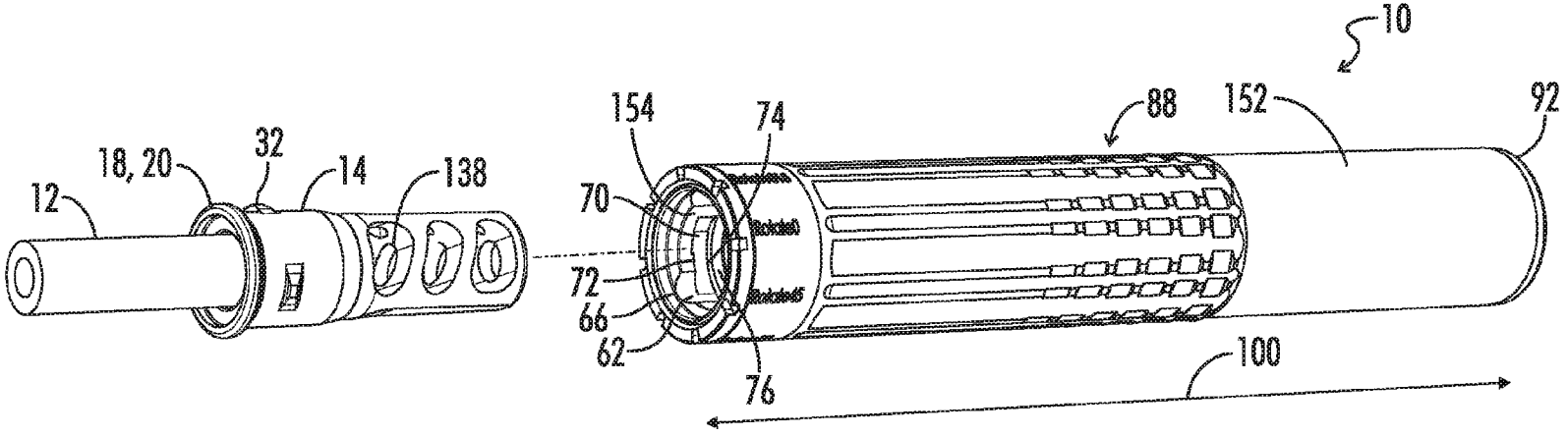
FIG. 4A illustrates a partially exploded, side perspective view of the firearm suppressor system of FIGS. 1A-1E.
Figure 4B:
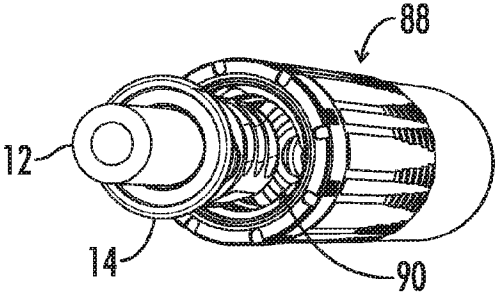
FIG. 4B illustrates a partially exploded, rear perspective view of the firearm suppressor system of FIGS. 1A-1E.
Figure 4C:
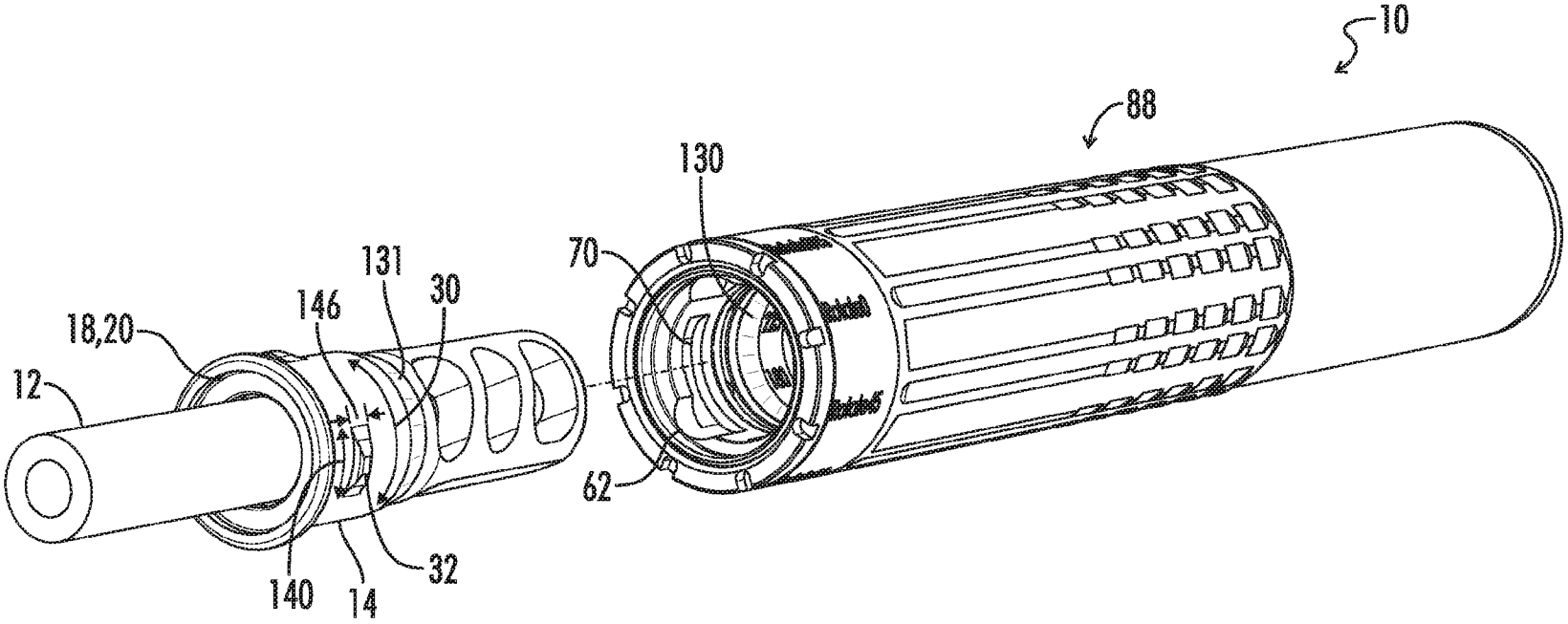
FIG. 4C illustrates a partially exploded, rear perspective view of the firearm suppressor system of FIGS. 1A-1E.
Figure 4D:
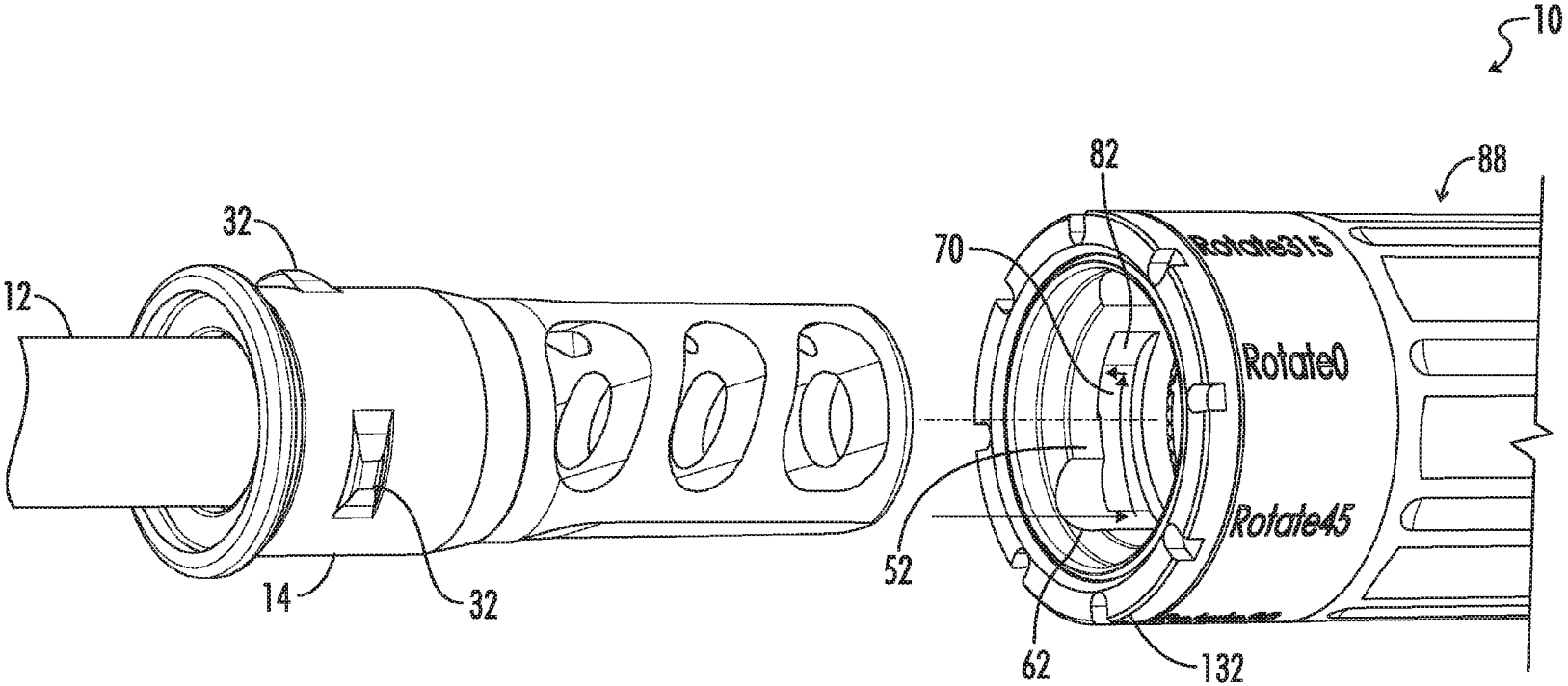
FIG. 4D illustrates a partially exploded, side perspective view of the firearm suppressor system of FIGS. 1A-1E.
Figure 5B:
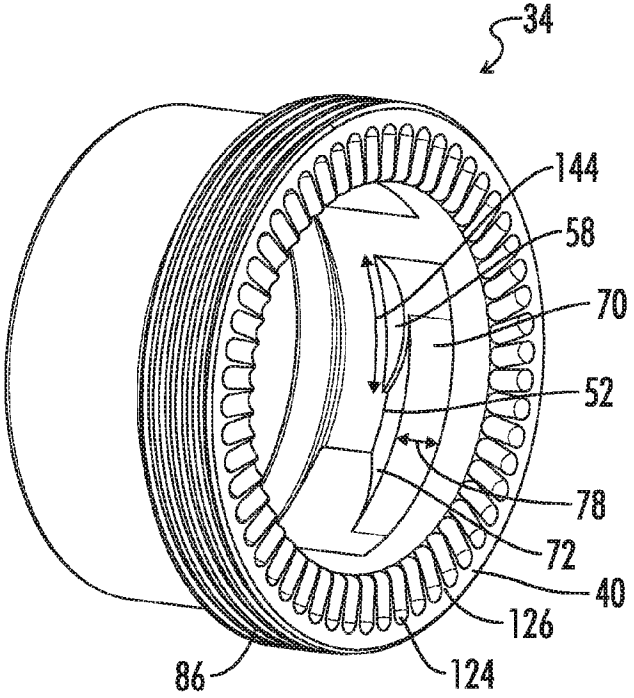
FIG. 5B illustrates a front, perspective view of the mount retention ring of FIG. 5A.
Figure 5A:
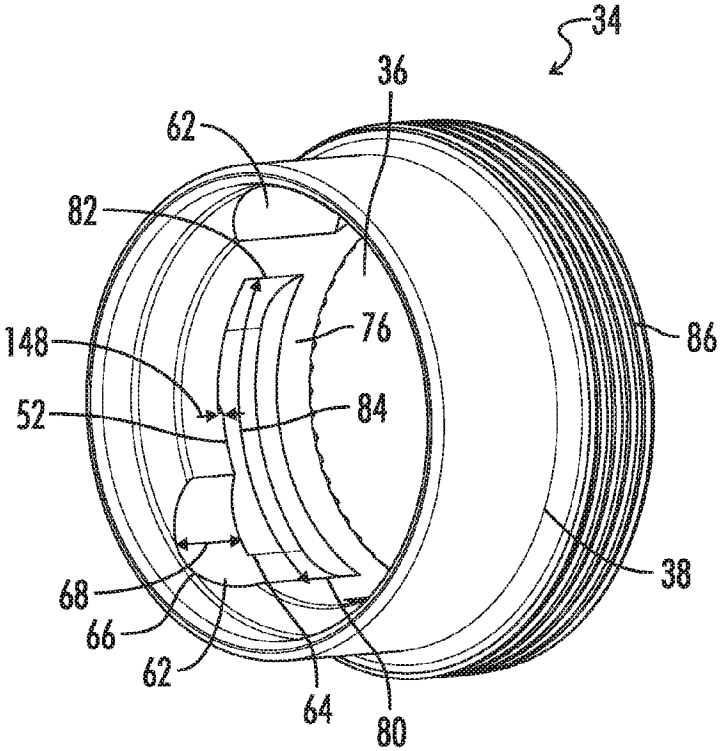
FIG. 5A illustrates a rear, perspective view of the mount retention ring of the firearm suppressor system of FIGS. 1A-1E.
Figure 5D:
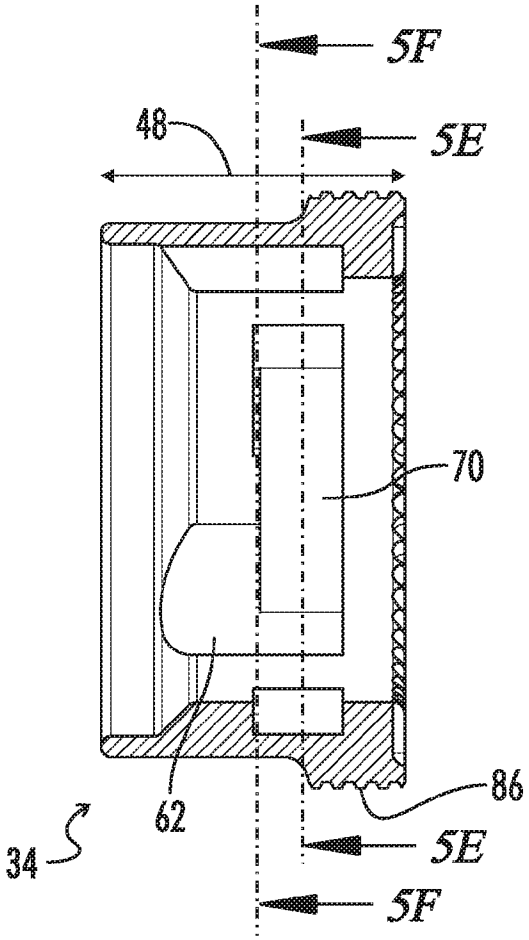
FIG. 5D illustrates a cross-sectional view of the mount retention ring of FIG. 5C, taken along line 5D-5D of FIG. 5C.
Figure 5C:
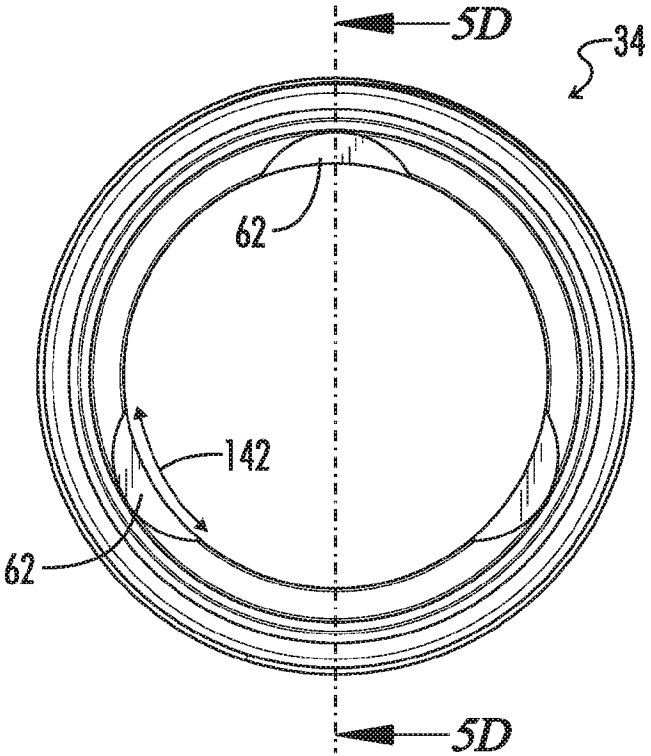
FIG. 5C illustrates a front, elevation view of the mount retention ring of FIG. 5A.
Figure 5F:
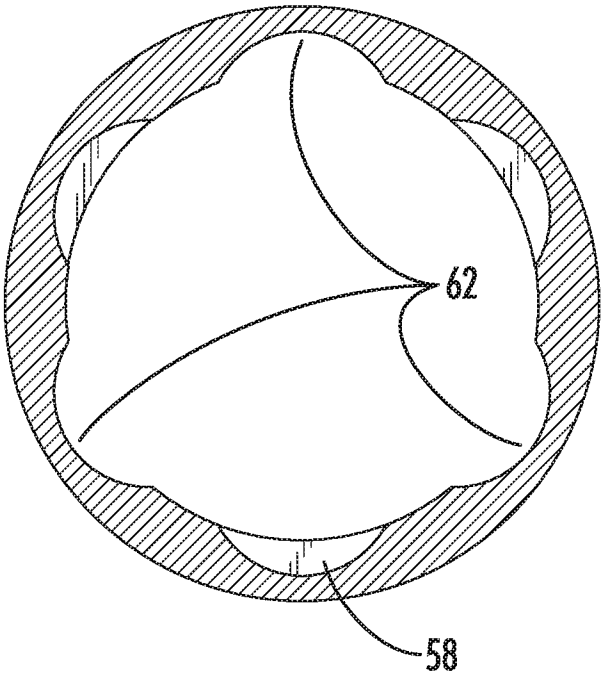
FIG. 5F illustrates a cross-sectional view of the mount retention ring of FIG. 5D, taken along line 5F-5F of FIG. 5D.
Figure 5E:
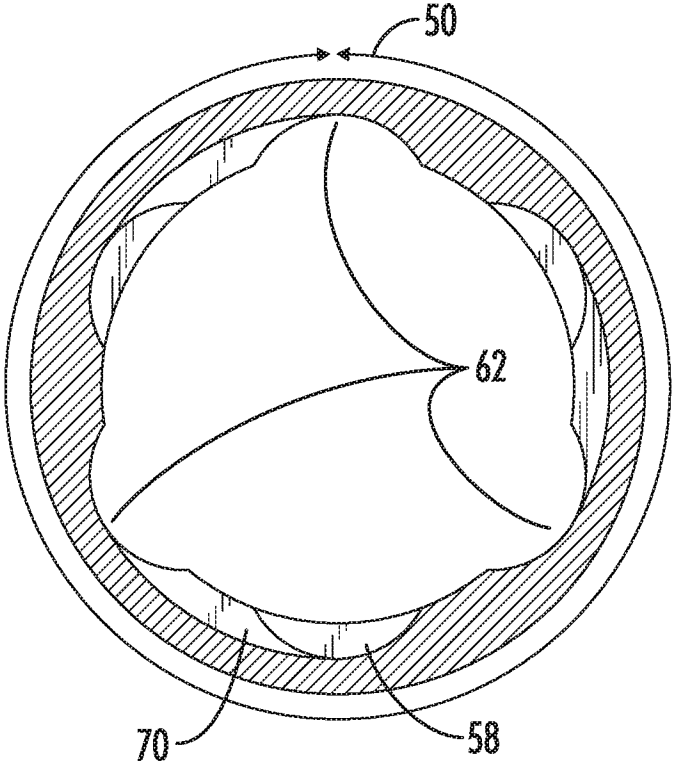
FIG. 5E illustrates a cross-sectional view of the mount retention ring of FIG. 5D, taken along line 5E-5E of FIG. 5D.
Figure 6B:
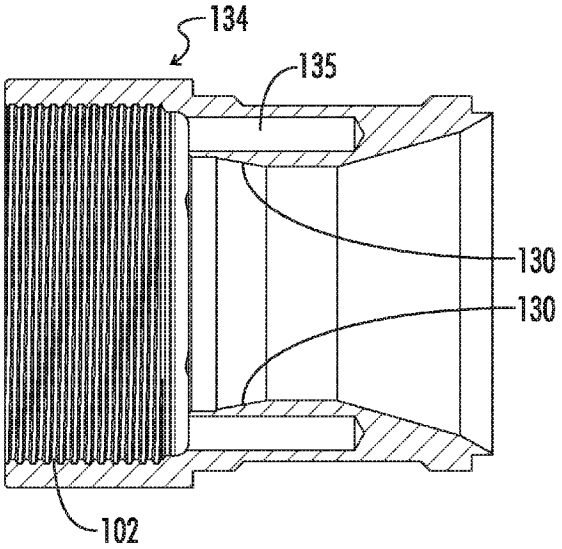
FIG. 6B illustrates a cross-sectional view of the taper mount cap of FIG. 6A, taken along line 6B-6B of FIG. 6A.
Figure 6A:
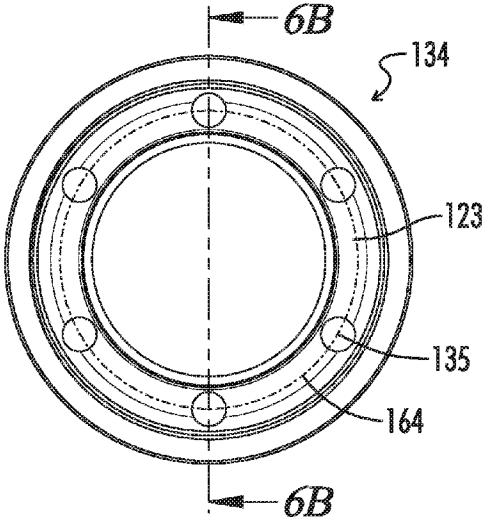
FIG. 6A illustrates a rear elevation view of the taper mount cap of the firearm suppressor system of FIGS. 1A-1E.
Figure 6C:
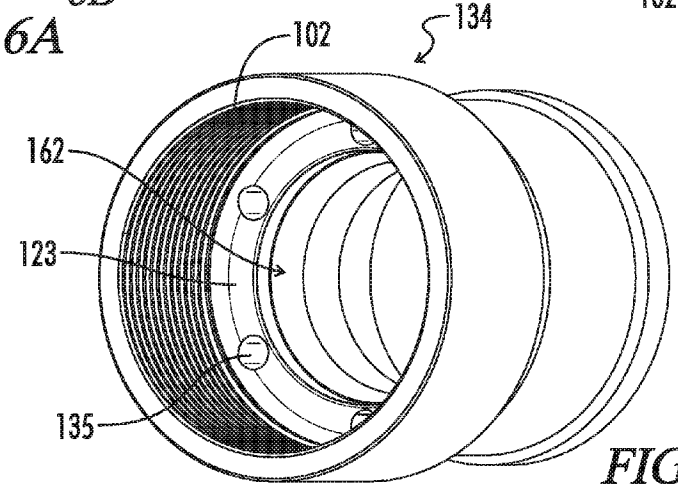
FIG. 6C illustrates a rear perspective view of the taper mount cap of FIG. 6A.
Figures 7A, 7B, 7C, 7D, 7E, 7F:
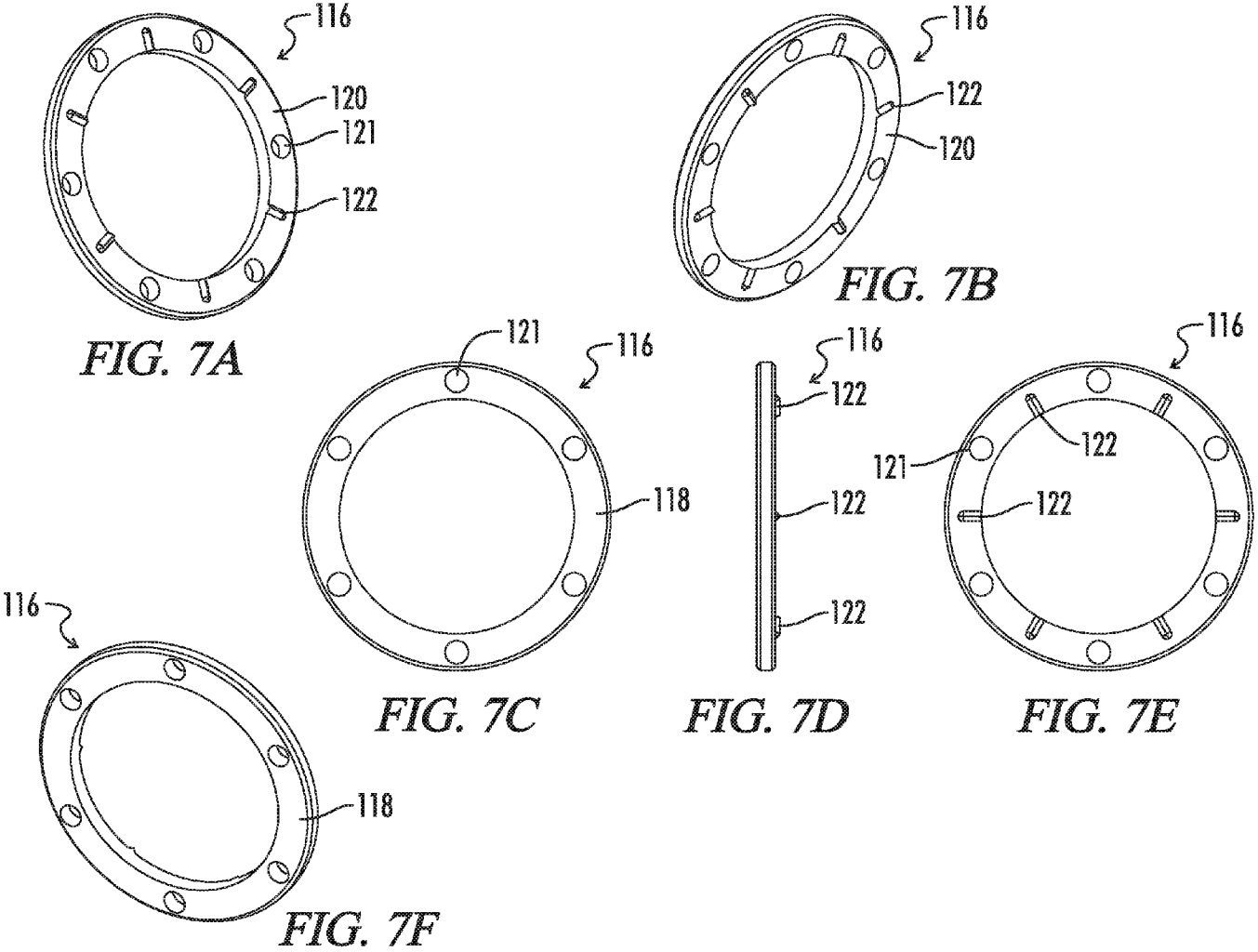
FIG. 7A illustrates a rear, perspective view of the ratchet retention ring of the firearm suppressor system of FIGS. 1A-1E.
FIG. 7B illustrates another rear perspective of the ratchet retention ring of FIG. 7A.
FIG. 7C illustrates a front elevation view of the ratchet retention ring of FIG. 7A.
FIG. 7D illustrates a side elevation view of the ratchet retention ring of FIG. 7A.
FIG. 7E illustrates a rear elevation view of the ratchet retention ring of FIG. 7A.
FIG. 7F illustrates a front perspective view of the ratchet retention ring of FIG. 7A.

The firearm barrel accessory system 10 further includes a mount retention ring 34. In some embodiments, the mount retention ring 34 comprises a mount retention ring interior wall 154 forming a mount retention ring interior 36, which receives the muzzle break 14. The mount retention ring 34 further includes a mount retention ring exterior 38, a mount retention ring forward end 40 comprising a mount retention ring forward opening 42 leading to the mount retention ring interior 36, a mount retention ring rear end 44 comprising a mount retention ring rear opening 46 leading to the mount retention ring interior 36, a mount retention ring length 48 extending from the mount retention ring forward end 40 to the mount retention ring rear end 44, a mount retention ring circumference 50 perpendicular to the mount retention ring length 48, and a lock to removably attach to the muzzle break 14. In some embodiments, the lock is comprised of one or more grooves in the interior wall 154 (more particularly, two or more longitudinal grooves 62, each of which leads to a circumferential groove 70), as explained below. More particularly, the mount retention ring interior wall 154 includes a plurality of longitudinal grooves 62 adjacent to the mount retention ring rear end 44, each longitudinal groove 62 having a longitudinal groove forward end 64, a longitudinal groove rear end 66, a longitudinal groove length 68 extending from the longitudinal groove forward end 64 to the longitudinal groove rear end 66, the longitudinal groove length 68 extending partially about the mount retention ring length 48, each of the longitudinal grooves 62 configured to allow a lug 32 of the plurality of lugs to pass therethrough. The mount retention ring interior wall 154 further includes a plurality of circumferential grooves 70, each of the plurality of circumferential grooves 70 located at the forward end 64 of a longitudinal groove 62 and extending partially about the mount retention ring circumference 50, each of the plurality of circumferential grooves 70 configured to receive a lug 32 from a longitudinal groove 62 and having a circumferential groove rear side 72 defined by a rear ledge 52 in the interior wall 154 and the forward end 64 of a longitudinal groove 62 and a circumferential groove forward side 74 defined by a forward ledge 76 located in the mount retention ring interior 36, the forward ledge 76 forwardly located relative to the rear ledge 52 within the mount retention ring interior 36. The circumferential groove 70 includes a circumferential groove thickness 78 extending from the circumferential groove forward side 74 to the circumferential groove rear side 72, a circumferential groove first radial side 80 located adjacent to one of the longitudinal grooves 62, a circumferential groove second radial side 82 opposite the first radial side 80, a circumferential groove length 84 extending from the first radial side 80 to the second radial side 82 and generally parallel to the mount retention ring circumference 50. In other words, the circumferential groove lengths 84 are generally perpendicular to the longitudinal groove lengths 68. The mount retention ring 34 further includes a plurality of indentations 58 (as best seen in FIG. 5B), each indentation 58 located in a rear ledge 52 adjacent to a second radial side 82 of a circumferential groove 70 and extending toward the mount retention ring rear end 44. Each indentation 58 is a cut-out in a rear ledge 52 and matches the shape of a lug 32 as best seen in FIG. 51B. The mount retention ring 34 further includes a plurality of mount retention ring threads 86 spaced about the exterior 38 of the mount retention ring 34. The number of indentations 58, circumferential grooves 70 and longitudinal grooves 62 is equal to the number of lugs 32 as each lug 32 is moved along a longitudinal groove 62, into a circumferential groove 70 and into an indentation 58 as explained below, and best seen in FIG. 4D. It will also be understood that herein use of the singular embraces use of the plural and use of the plural embraces use of the singular unless the context requires otherwise. Thus, the firearm barrel accessory system 10 may include only one lug 32, in which case, only one longitudinal groove 62, one circumferential groove 70 and one indentation 58 is required; however, multiple lugs 32 (preferably three lugs) is preferred and provides a securer attachment.

The firearm barrel accessory system 10 further includes a silencer barrel 88 comprising a silencer barrel interior 90 comprising the mount retention ring 34, a silencer barrel exterior wall 152 (i.e., the outside of the silencer barrel 88), a silencer barrel front end 92 comprising a silencer barrel forward opening 94 leading to the silencer barrel interior 90 and configured to fire the ammunition, a silencer barrel rear end 96 comprising a silencer barrel rear opening 98 comprising the muzzle break 14 and leading to the silencer barrel interior 90, a silencer barrel length 100 extending from the silencer barrel front end 92 to the silencer barrel rear end 96, and plurality of silencer barrel threads 102 located in the silencer barrel interior 90 and mating with the mount retention ring threads 86. When the ammunition is fired from the firearm 9, the ammunition is configured to pass from the gun barrel 12, through the muzzle break interior 16, through the mount retention ring interior 36, and out the silencer barrel forward opening 94. The silencer barrel interior 90 preferably is configured to dampen/reduce noise emanating from the firearm barrel accessory system 10. The silencer barrel interior 90 may include any suitable noise suppressing apparatus, including those now known or later developed, including without limitation baffles 128 located forwardly in the silencer barrel interior 90 relative to the silencer barrel threads 102. The silencer barrel 88 comprises a longitudinal axis 156 parallel to the silencer barrel length 100 and passing through the silencer barrel interior 90. Preferably, rotating/twisting the silencer barrel 88 (more particularly the exterior wall 152 of the silencer barrel 88) a first rotation about the longitudinal axis 156 relative to the muzzle break 14 and the gun barrel 12 when each lug 32 is located in a circumferential groove 70 and adjacent to the first radial side 80 and adjacent to a rear ledge 52 is configured to rotate the mount retention ring 34 so that each second radial side 82 moves toward and contacts a lug 32, and further wherein rotating the silencer barrel 88 a second rotation in the same direction as the first rotation about the longitudinal axis 156 relative to the muzzle break 14 and the gun barrel 12 when each lug 32 is located in a circumferential groove 70 and contacting the second radial side 82 is configured to move the mount retention ring threads 86 about the silencer barrel threads 102 and to move the mount retention ring 34 longitudinally within the silencer barrel interior 90 toward the silencer barrel front end 92 so that the indentation 58 approaches and contacts one of the lugs 32.

Preferably, the mount retention ring threads 86 are not configured to move about the silencer barrel threads 102 during the first rotation and the mount retention ring 34 is configured to remain a fixed distance from the silencer barrel front end 92 during the first rotation. In other words, the mount retention ring 34 only rotates relative to the muzzle break 14 during the first rotation—as opposed to moving longitudinally.

Preferably, the spacing between the lugs 32 along the muzzle break circumference 30 is substantially equal to the spacing between the longitudinal grooves 62 about the mount retention ring circumference 50.

Preferably, the muzzle break 14 comprises a tapered portion 131 located forwardly relative to the lugs 32 and configured to contact a tapered portion 130 of the interior wall of the silencer barrel 88 when the plurality of lugs 32 are located in the plurality of circumferential grooves 70 and further wherein the contact between the tapered portion 131 of the muzzle break 14 and the tapered portion 130 of the interior wall of the silencer barrel 88 is configured to prevent the muzzle break 14 from moving toward the silencer barrel front end 92.

Preferably, the forward ledges 76 are configured to prevent the plurality of lugs 32 from moving forwardly within the silencer barrel interior 90 beyond the forward ledges 76.

Preferably, the entire mounting apparatus is configured to be operated by a user using one hand to rotate the silencer barrel exterior wall 152.

Preferably, all components for attaching the muzzle break 14 to the silencer barrel 88 are located in the silencer barrel interior 90 when the silencer barrel 88 is locked to the muzzle break 14.

Preferably, the muzzle break 14 further comprises plurality of gas ports 138 configured to reduce flash and further wherein the lugs 32 are located rearwardly relative to the gas ports 138.

Preferably, each lug 32 comprises a lug width 140 generally perpendicular to the muzzle break circumference 30, wherein each of the longitudinal grooves 62 comprises a longitudinal groove width 142 generally parallel to the mount retention ring circumference 50, each indentation 58 comprises an indentation width 144 generally parallel to the mount retention ring circumference 50, wherein the width 140 of each respective lug 32 is approximately equal in size to the width 142 of the longitudinal groove 62 that the lug 32 passes through, and further wherein the width 140 of each respective lug 32 is less than the length 84 of the circumferential groove 70 that the lug 32 passes through. Preferably, the width 140 of each respective lug 32 is substantially equal to the width 144 of the indentation 58 that the lug 32 is moved into. Preferably the lugs 32 are generally pyramidal in shape. Preferably, the lugs 32 each have a lug length 146 generally parallel to the muzzle break length 26 wherein the indentations 58 each have an indentation length 148 generally parallel to the mount retention ring length 48, and further wherein the length 146 of each respective lug 32 is greater than the length 148 of the indentation 52 that the lug 32 is moved into. Preferably, each of the plurality of lugs 32 have the same shape.

Figure 1C:
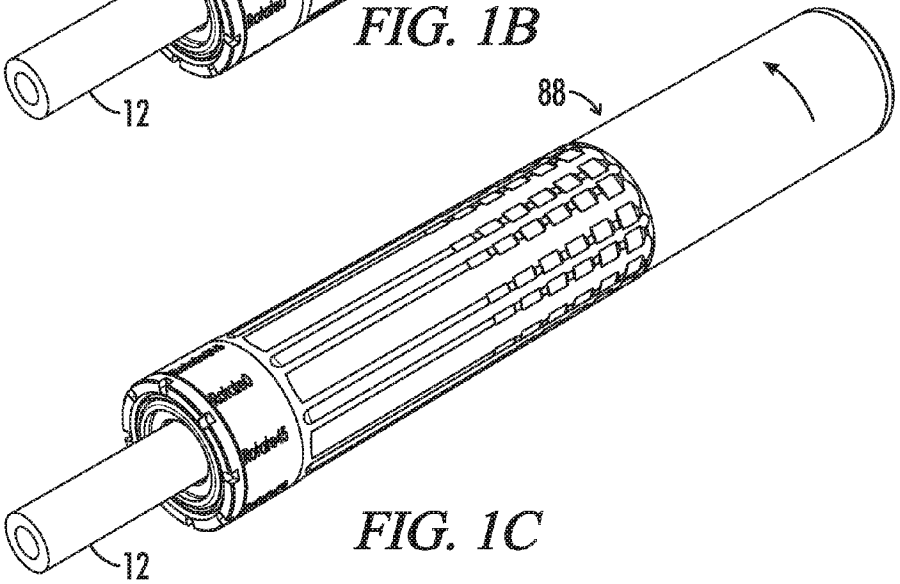
FIG. 1C illustrates an assembled, side perspective view of the firearm suppressor system of FIG. 1B; as compared to FIG. 1B, in FIG. 1C the silencer barrel exterior wall and the mount retention ring have been rotated 60 degrees counter-clockwise (into the page) relative to the muzzle break.
Figure 1D:
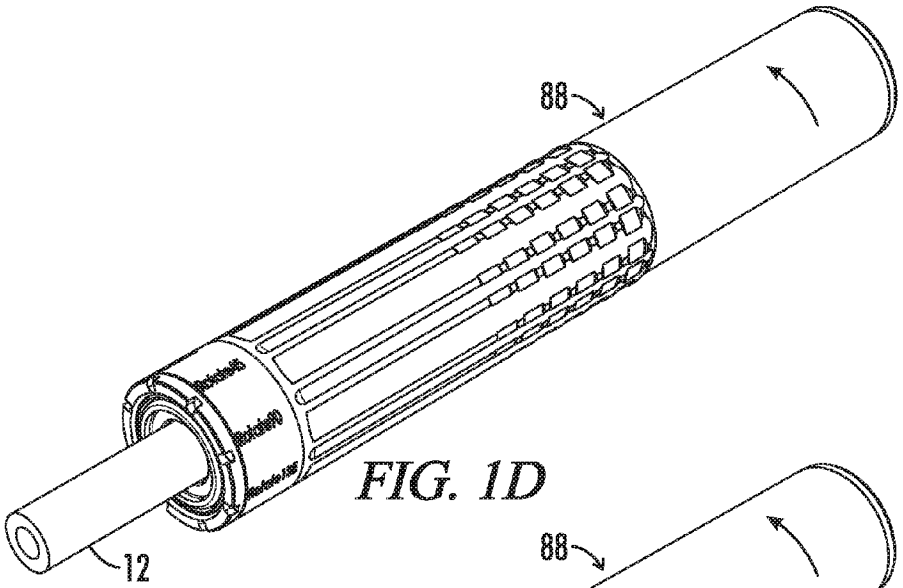
FIG. 1D illustrates an assembled, side perspective view of the firearm suppressor system of FIG. 1C; as compared to FIG. 1C, in FIG. 1D the silencer barrel exterior wall has been rotated 30 degrees counter-clockwise (into the page) relative to the muzzle break and the mount retention ring and the mount retention ring has moved forwardly within the silencer barrel interior relative to FIG. 1C.
Figure 1E:
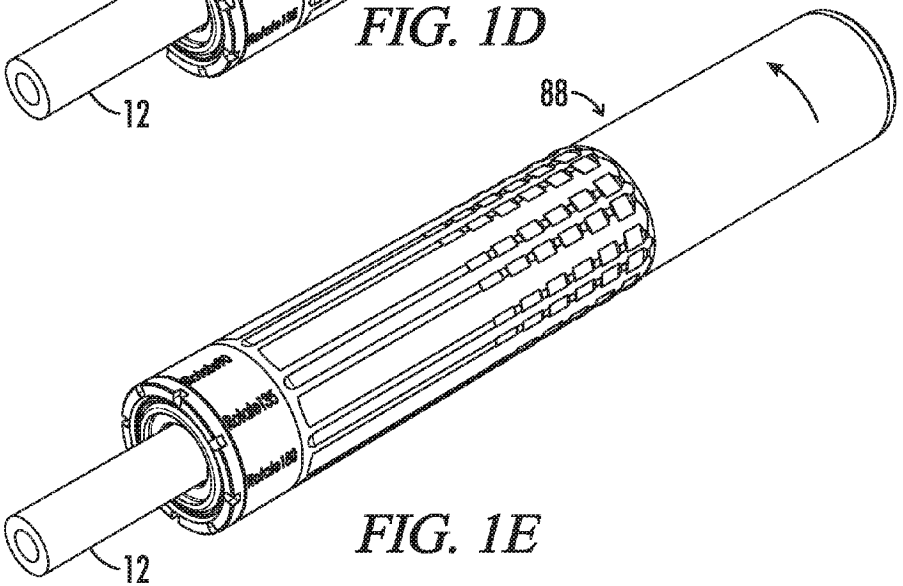
FIG. 1E illustrates an assembled, side perspective view of the firearm suppressor system of FIG. 1D; as compared to FIG. 1D, in FIG. 1E the silencer barrel exterior wall has been rotated 30 degrees counter-clockwise (into the page) relative to the muzzle break and the mount retention ring, and the mount retention ring has moved forwardly within the silencer barrel interior relative to FIG. 1D.
Figure 8A:
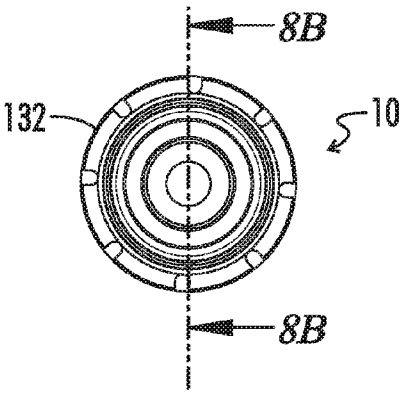
FIG. 8A illustrates a rear elevation view of the firearm suppressor system of FIGS. 1A-1E.
Figure 8B:
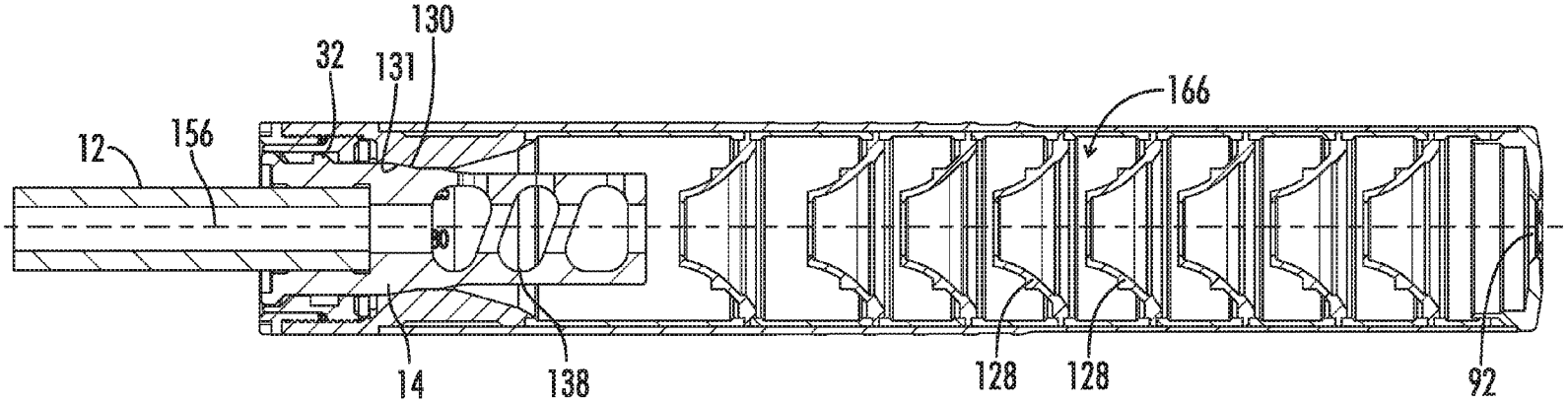
FIG. 8B illustrates a cross-sectional view of the firearm suppressor system of FIG. 8A, taken along line 8B-8B of FIG. 8A.
Figure 9A:
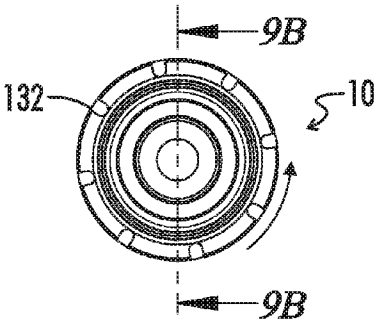
FIG. 9A illustrates a rear elevation view of the firearm suppressor system of FIG. 8A.
Figure 9B:
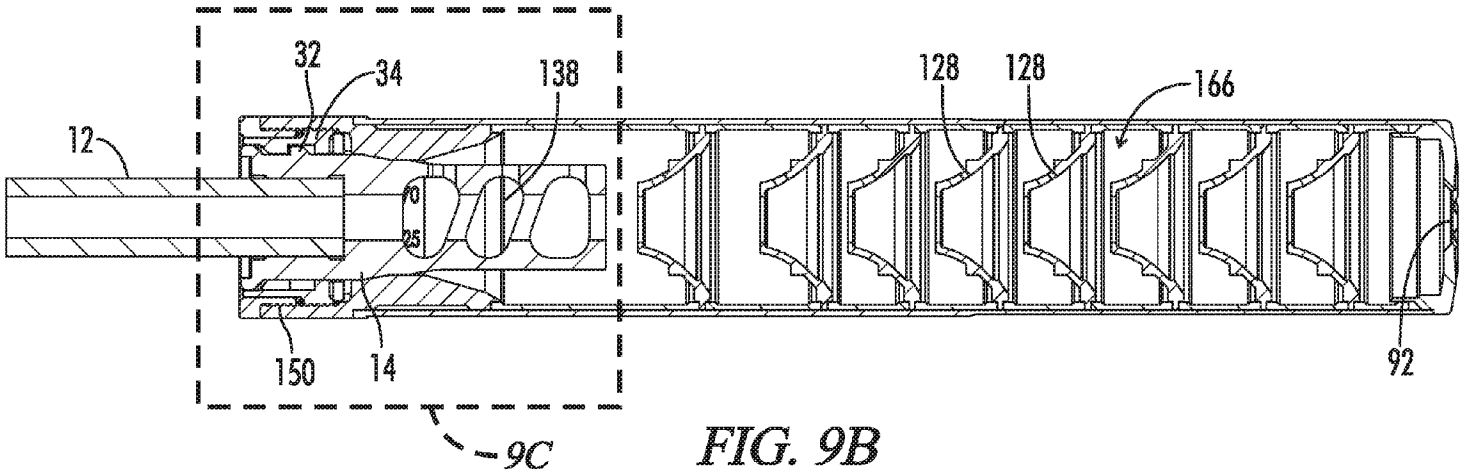
FIG. 9B illustrates a cross-sectional view of the firearm suppressor system of FIG. 9A, taken along line 9B-9B of FIG. 9A.
Figure 10A:
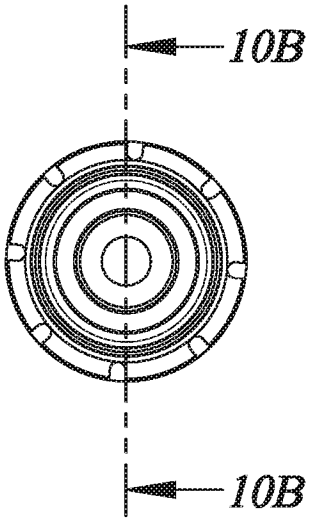
FIG. 10A illustrates a rear elevation view of the firearm suppressor system of FIG. 8A.
Figure 9C:
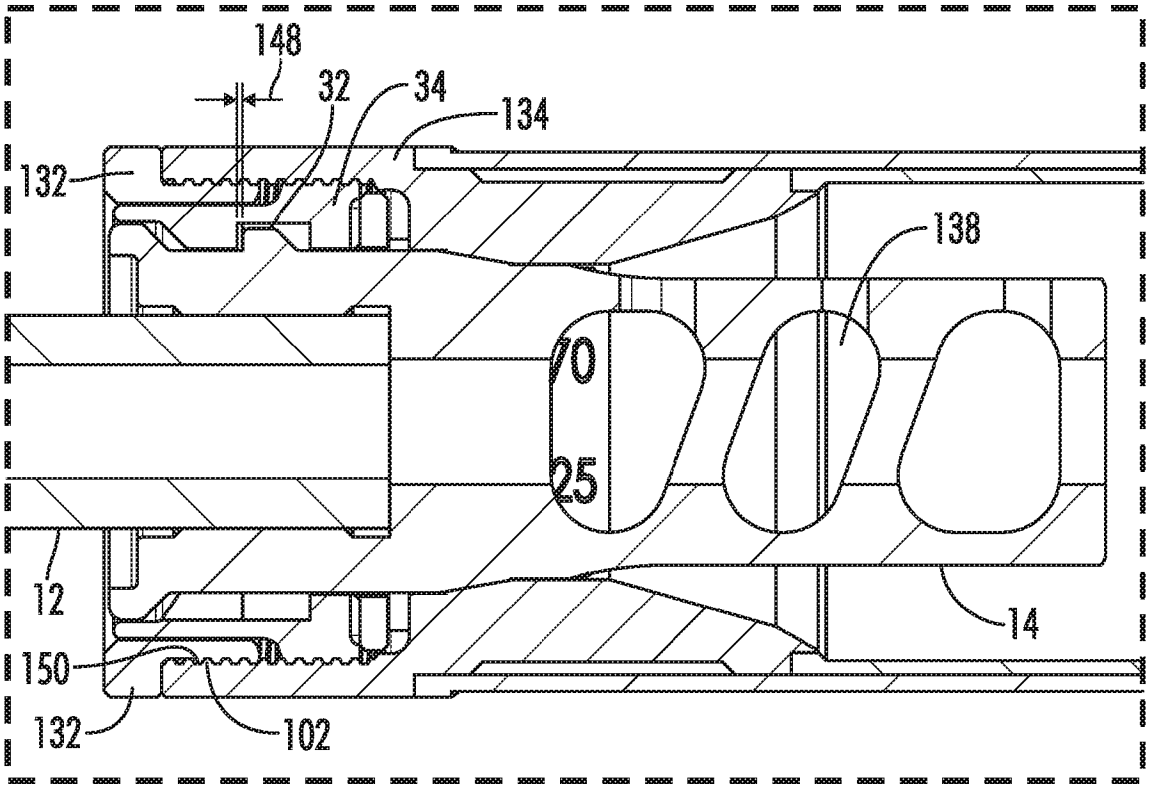
FIG. 9C illustrates a closeup cross sectional view of the muzzle break and mount retention ring of FIG. 9B.
Figure 10B:
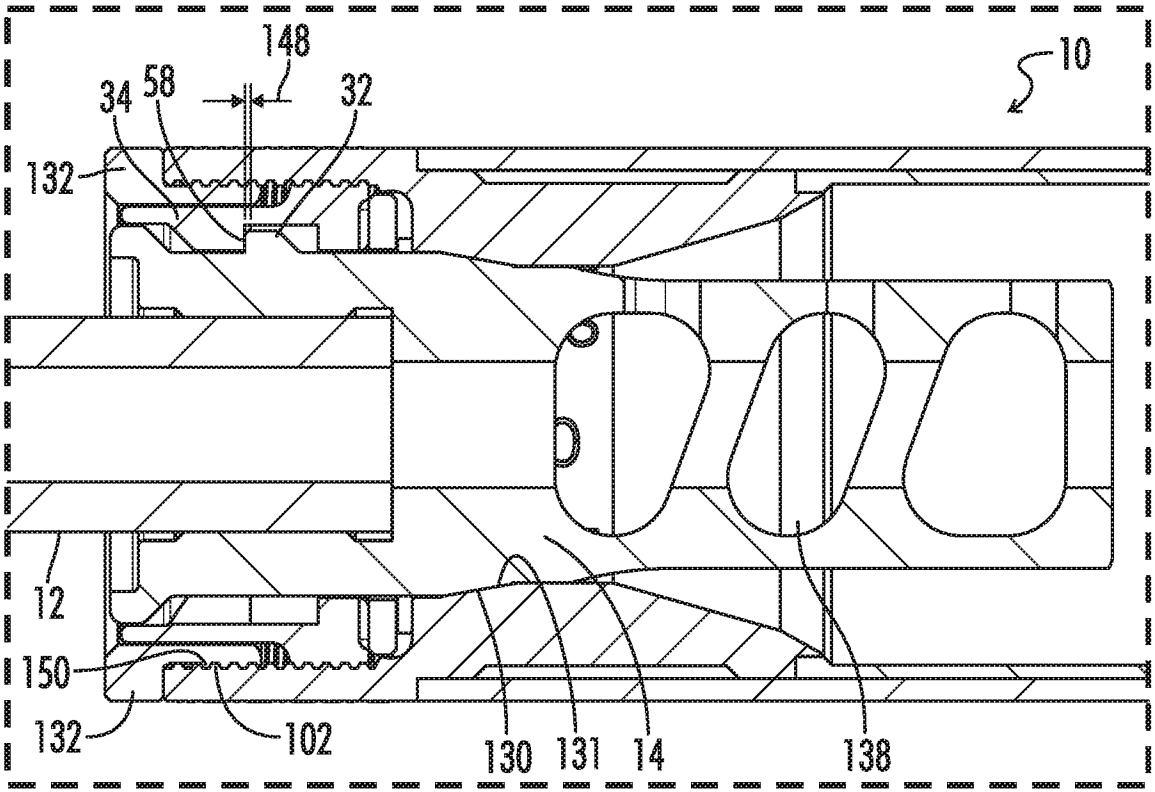
FIG. 10B illustrates a cross-sectional view of the muzzle break and the mount retention ring of FIG. 10A, taken along line 10B-10B of FIG. 10A; it being understood that FIG. 10B is a closeup view similar to FIG. 9C.
Figure 11A:
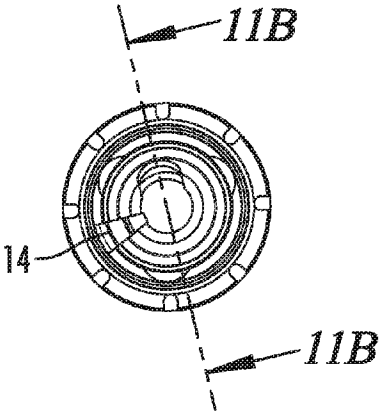
FIG. 11A illustrates a rear elevation view of the firearm arm suppressor system of FIG. 8A, in FIG. 11A the silencer barrel and the mount retention ring have been rotated 36 degrees counter-clockwise relative to the muzzle break and the muzzle break is partially cut away to better show the lug, retention springs and the ratchet retention ring.
Figure 11B:
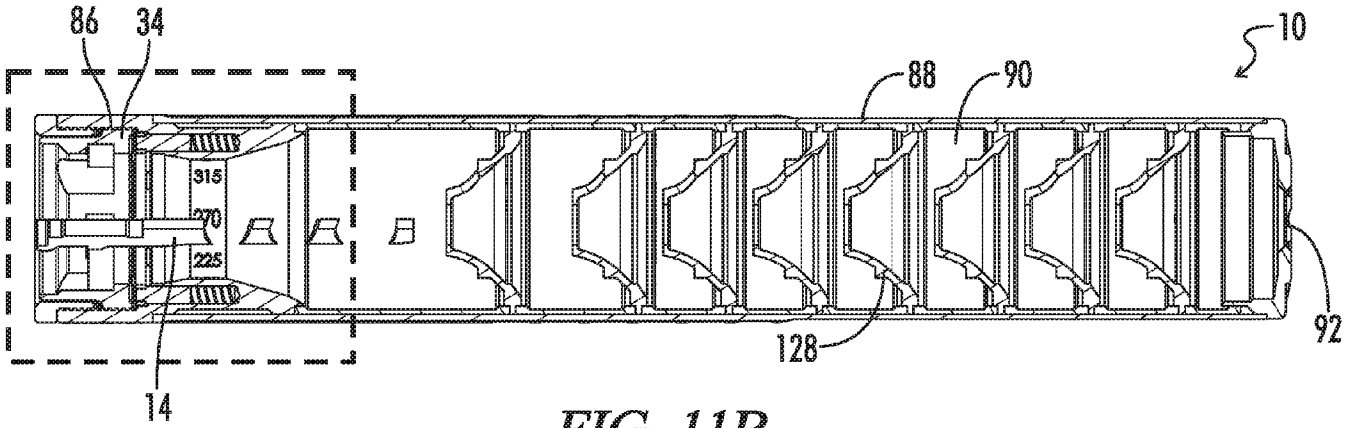
FIG. 11B illustrates a cross-sectional view of the firearm suppressor system of FIG. 11A, taken along line 11B-11B of FIG. 11A.
Figure 11C:
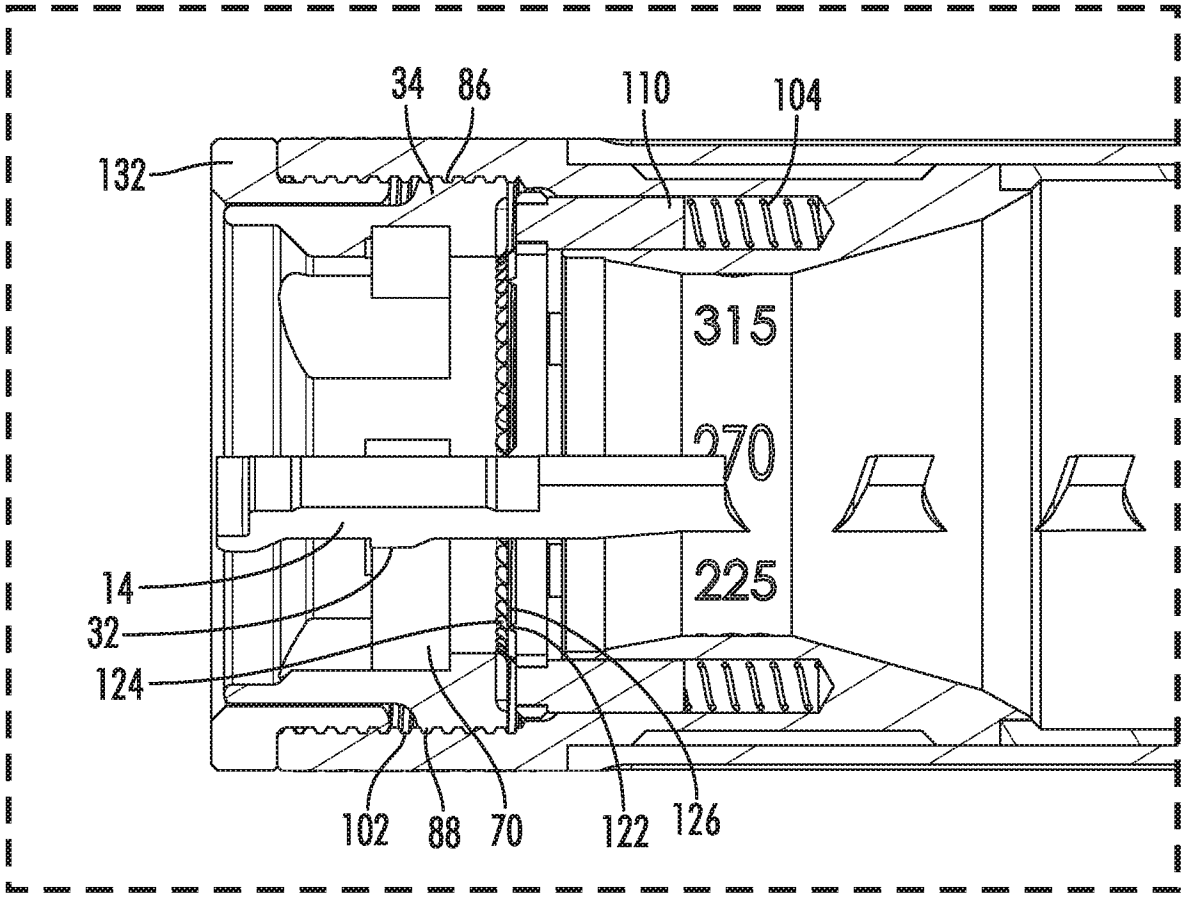
FIG. 11C illustrates a closeup cross sectional view of the muzzle break and mount retention ring, ratchet retention ring and retention springs of FIG. 11B.

To attach the silencer barrel 88 to the muzzle break 14, the muzzle break 14 is inserted into the mount retention ring interior 36 so that the lugs 32 pass through the longitudinal grooves 62 and into the circumferential grooves 70 adjacent to the circumferential grooves first radial ends 80. The silencer barrel exterior wall 152 is rotated the first rotation relative to the muzzle break 14 so that the lugs 32 move to the circumferential groove second radial ends 82. The silencer barrel exterior wall 152 is then rotated the second rotation relative to the muzzle break 14 so that the lugs 32 contact the circumferential groove second radial ends 82 and cause the mount retention ring threads 86 to move along the silencer barrel threads 102 and cause the mount retention ring 34 to move forwardly within the silencer barrel interior 90 so that the indentations 58 move toward the lugs 32. The attachment sequence is illustrated in FIGS. 1A-1E and 8-11, where the first rotation of the silencer exterior wall 152 relative to the muzzle break 14 is 60 degrees and the second rotation of the silencer exterior wall 152 relative to the muzzle break 14 is 120 degrees. (It will be understood that these degree intervals are merely exemplary and that other intervals may be used. It will also be understood that in operation of the system 10, the second rotation will occur immediately after the first rotation without any pause by the user). More particularly, in FIG. 1A, the muzzle break 14 is provided and, in FIG. 1B, the muzzle break 14 is inserted so that the lugs 32 travel along the longitudinal grooves 62. (FIG. 8B shows a cross-sectional view of FIG. 1B and it can be seen that the tapered portion 131 of the muzzle break 14 is contacting the tapered portion 130 of the interior wall of the silencer barrel 88). In FIG. 1C the silencer barrel exterior wall 152 and the mount retention ring 34 have been rotated 60 degrees counter-clockwise (into the page) relative to the muzzle break 14 as compared to FIG. 11 and the lugs 32 have travelled along the circumferential grooves 62, (FIG. 9B shows a cross-sectional view of the FIG. 1C rotation and it can be seen that a gap exists between the lug 32 and indentation 58). In FIG. 1D the silencer barrel exterior wall 152 has been rotated 30 degrees counter-clockwise (into the page) relative to the muzzle break 14 and the mount retention ring 34, and the mount retention ring 34 has moved forwardly within the silencer barrel interior 90 relative to FIG. 1C, as the mount retention ring threads 86 move along the silencer barrel threads 102. In other words, FIG. 1D represents the halfway point of the second rotation. In FIG. 1E the silencer barrel exterior wall 152 has been rotated 30 degrees counter-clockwise (into the page) relative to the muzzle break 14 and the mount retention ring 34, and the mount retention ring 34 has moved forwardly within the silencer barrel interior 90 relative to FIG. 1D as the mount retention ring threads 86 have continued to move along the silencer barrel threads 102. Thus, FIG. 1E represents the end of the second rotation. (FIG. 10B is a cross-sectional view of the rotation of FIG. 1E and shows the lug 32 located in the indentation 58). At FIG. 1E, the silencer barrel 88 is locked to the muzzle break 14 and the user can fire the firearm 9. In FIG. 4D, the muzzle break 14 is about to be inserted into mount retention ring interior 36, and the arrows show how the lugs 32 are moved through the longitudinal grooves 62 and into the circumferential grooves 70, then along the circumferential grooves 70 and then towards the indentations 58. It will be understood that the arrows are provided for illustration purposes and in the attachment sequence of the system 10, the user moves the lugs 32 through the longitudinal grooves 62 by moving the muzzle break 14 longitudinally into the silencer barrel interior 90 and then the muzzle break 14 and lugs 32 become stationary and the circumferential grooves 70 and the indentations 58 move relative to the stationary lugs 32 by the user rotating the silencer barrel exterior wall 152.

The indentation length 148 may be very small. (e.g., from about 1/1000 to about 50/1000 of an inch so that the mount retention ring 34 only moves longitudinally a small amount within the silencer barrel interior 90).

To remove the silencer barrel. 88, the silencer barrel exterior 152 is rotated clockwise 120 degrees relative to the muzzle break 14 so that the indentations 58 move away from the lugs 32, the lugs 32 travel in the reverse direction along the circumferential grooves 70 and in the reverse direction along the longitudinal grooves 62 and the muzzle break 14 is moved out of the mount retention ring interior 36. A purpose of the indentations 58 is to provide a cam action to assist in the reverse rotation of the silencer barrel exterior wall 152 relative to the muzzle break 14.

Figure 2:
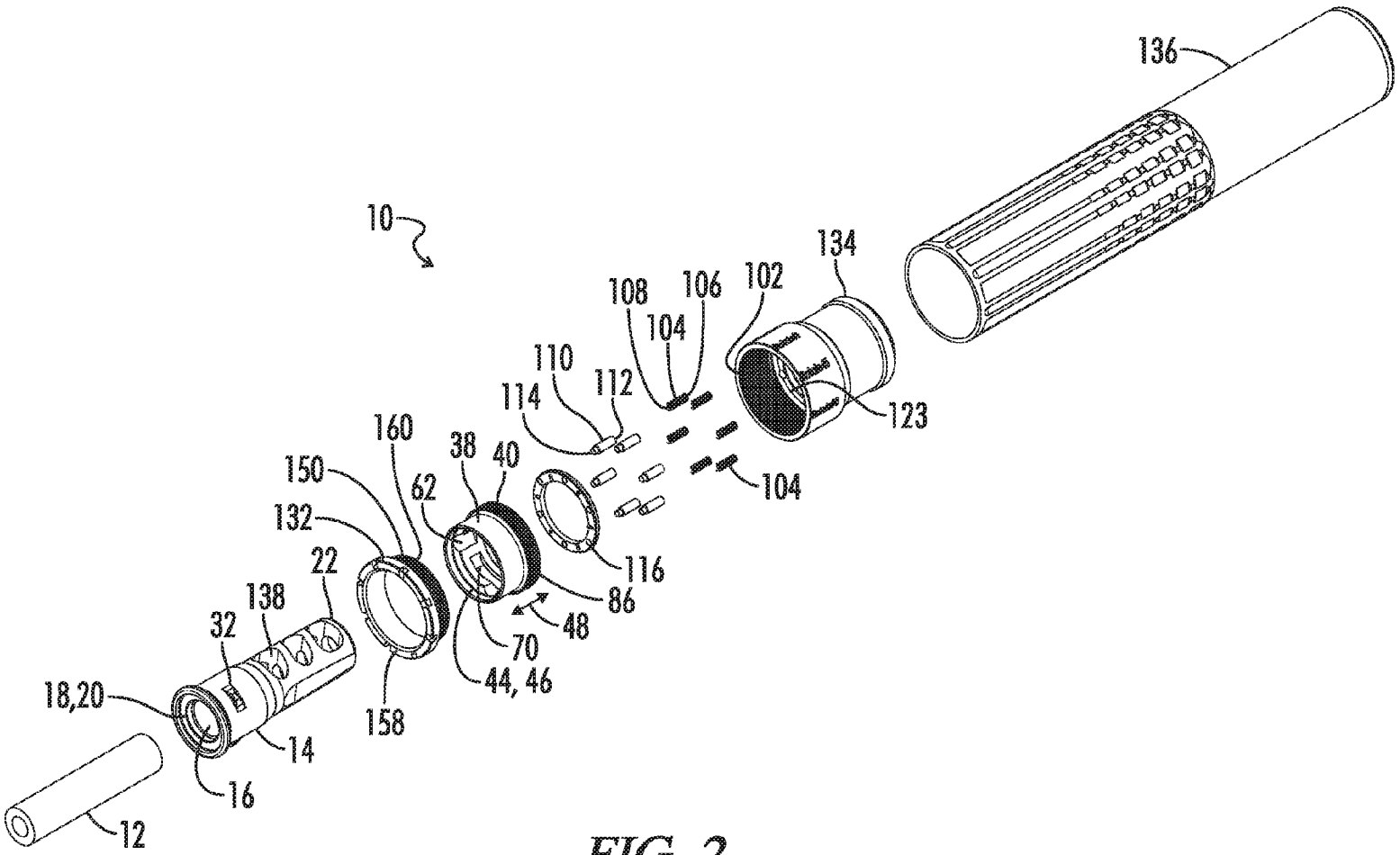
FIG. 2 illustrates a side exploded perspective view of the firearm suppressor system of FIGS. 1A-1E.
Figure 3:
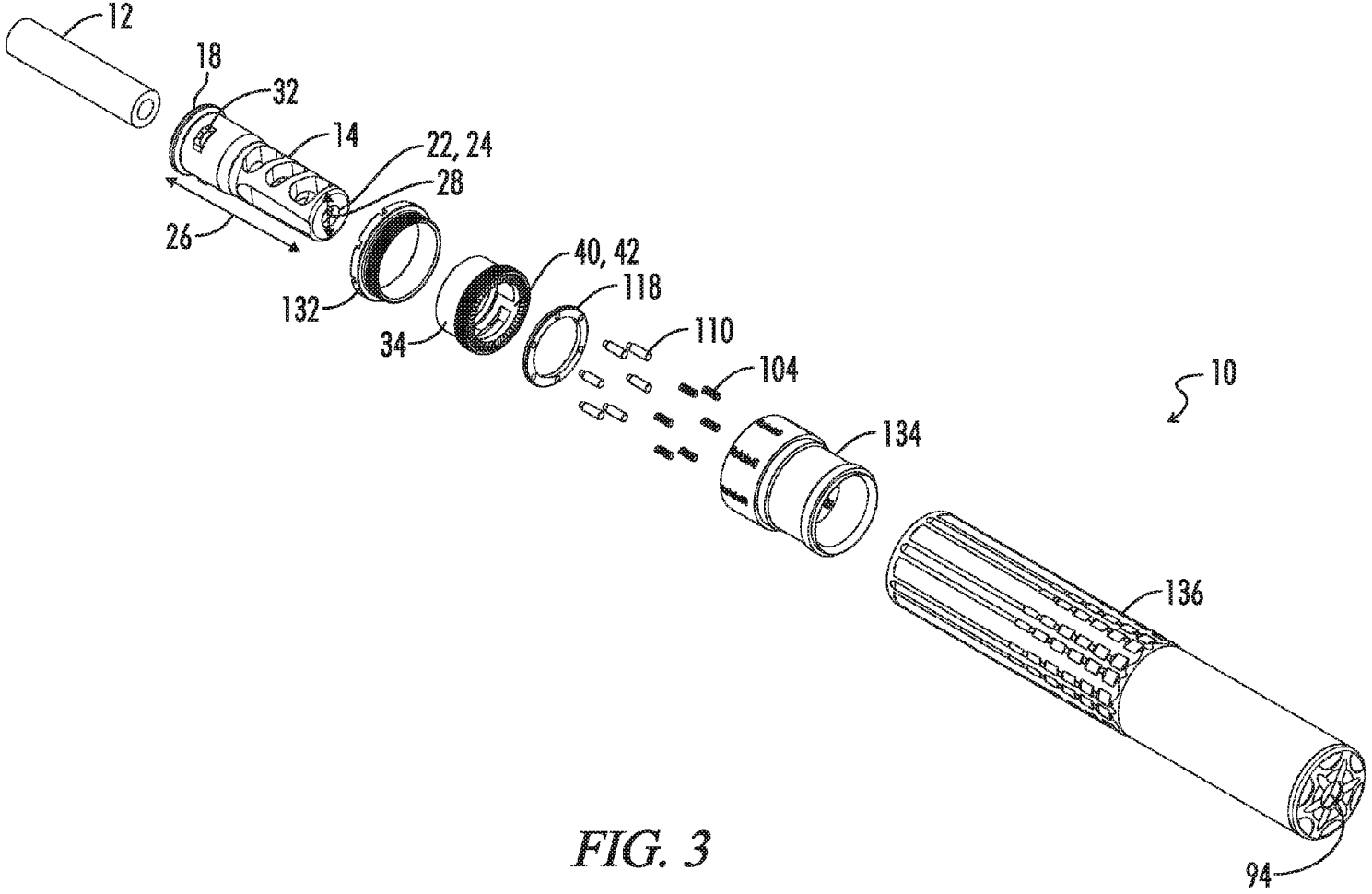
FIG. 3 illustrates another side exploded perspective view of the firearm suppressor system of FIG. 1A-1E.

The silencer barrel 88 may be comprised of a plurality of separate components, as best seen in FIGS. 2 and 3. For example, a tube locking ring 132 may form the rear end 96 of the silencer barrel 88. The tube locking ring 132 may have a tube locking ring rear end 158 comprising the silencer barrel rear opening 98 and a tube locking ring forward end 160 comprising a plurality of tube locking ring threads 150. The mount retention ring threads 86 may be disposed forwardly within the silencer barrel interior 90 relative to the tube locking ring threads 150 and the mount retention ring 34 may include a plurality of grooves 124 spaced about the circumference 50 of the forward end 40 of the mount retention ring 34. Adjacent mount retention ring forward end grooves 124 are separated by a ridge 126. The silencer barrel 88 may further include a ratchet retention ring 116 comprising a forward end 118 facing the forward end 92 of the silencer barrel 88 and a rear end 120 facing the plurality of the mount retention ring forward end grooves 124 and the ratchet retention ring 116 may include a plurality of holes 121 configured to receive the rear ends 114 of the retention pins 110 (described below), and a plurality of triangular teeth 122 configured to mate with the plurality of mount retention ring forward end grooves 124. The silencer barrel 88 may further include a taper mount cap 134 disposed forwardly relative to the tube locking ring 132, the taper mount cap 134 comprising a taper mount cap interior 162 comprising the mount retention ring 34, the ratchet retention ring 116, a taper mount cap ledge 123 disposed forwardly relative to the mount retention ring 34 and the ratchet retention ring 116 within the taper mount cap interior 162 and a plurality of taper mount cap threads 102 (i.e., previously referred to as the silencer barrel threads) configured to mate with the tube locking ring threads 150 and the mount retention ring threads 86, the taper mount cap ledge 123 comprising a taper mount cap ledge circumference 164 and a plurality of spring recesses 135 spaced about the taper mount cap ledge circumference 164. The silencer barrel interior 90 may further include a plurality of retention springs 104 seated inside the plurality of spring recesses 135, each spring 104 having a forward end 106 and a rear end 108. The taper mount cap interior 162 may further include a plurality of retention pins 110 located inside the taper mount cap interior 162, each retention pin 110 having a forward end 112 attached to a rear end 108 of a retention spring 104 and a rear end 114 attached to the ratchet retention ring 116. Optionally, the taper mount cap 134 may be attached to a sleeve 136 comprising a sleeve interior 166 comprising a plurality of baffles 128 and forming the forward end 92 of the silencer barrel 88. In such embodiments, the sleeve 136, the taper mount cap 134, the ratchet retention ring 116 and the tube locking ring 132 may be rotatable along the silencer barrel longitudinal axis 156 relative to the mount retention ring 34 and the muzzle break 14, wherein rotation of the sleeve 136, the taper mount cap 134, the ratchet retention ring 116 and the tube locking ring 132 relative to the mount retention ring 34 causes the mount retention ring 34 to move along the taper mount cap threads 102 and the silencer barrel length 100 and causes the teeth 122 to move about the mount retention ring forward end grooves 124, wherein the retention pins 110 exert tension on the ratchet retention ring 116 in the rear direction. Optionally, rotation of the sleeve 136, the taper mount cap 134, the ratchet retention ring 116 and the tube locking ring 132 relative to the mount retention ring 34 causes the mount retention ring 34 to move along the taper mount cap threads 102 and to move forwardly along the silencer barrel length 100 (and to move forwardly relative to the muzzle break 14). Among other advantages, the ratchet ring 116 is designed to prevent the mount retention ring threads 86 from unscrewing from/moving along the taper mount cap threads 102 during vibration occurring from shooting ammunition.

The drawings provided herein are engineering drawings to scale. However, it will be appreciated that other dimensions and component ratios are possible.

Having now described the invention in accordance with the requirements of the patent statutes, those skilled in the art will understand how to make changes and modifications to the disclosed embodiments to meet their specific requirements or conditions. Changes and modifications may be made without departing from the scope and spirit of the invention. In addition, the steps of any method described herein may be performed in any suitable order and steps may be performed simultaneously if needed.

Terms of degree such as "generally", "substantially", "about" and "approximately" as used herein mean a reasonable amount of deviation of the modified term such that the end result is not significantly changed. For example, these terms can be construed as including a deviation of at least ±5% of the modified term if this deviation would not negate the meaning of the word it modifies.

What is claimed is:

1. A firearm suppressor system comprising:

a) a firearm comprising a gun barrel configured to fire ammunition;

b) a muzzle break attached to the gun barrel and comprising a muzzle break interior receiving the gun barrel, a muzzle break rear end facing the firearm and comprising a muzzle break rear opening leading to the muzzle break interior, a muzzle break forward end comprising a muzzle break forward opening leading to the muzzle break interior and configured to eject the ammunition, a muzzle break length extending from the muzzle break forward end to the muzzle break rear end, a muzzle break width perpendicular to the muzzle break length, a muzzle break circumference perpendicular to the muzzle break length, and a plurality of lugs spaced about the muzzle break circumference;

c) a mount retention ring configured to receive the muzzle break and comprising an interior wall forming a mount retention ring interior, a mount retention ring exterior, a mount retention ring forward end comprising a mount retention ring forward opening leading to the mount retention ring interior, a mount retention ring rear end comprising a mount retention ring rear opening leading to the mount retention ring interior, a mount retention ring length extending from the mount retention ring forward end to the mount retention ring rear end, a mount retention ring circumference perpendicular to the mount retention ring length, a plurality of longitudinal grooves located in the interior wall, each longitudinal groove having a longitudinal groove forward end, a longitudinal groove rear end, a longitudinal groove length extending from the longitudinal groove forward end to the longitudinal groove rear end, the longitudinal groove length extending partially about the mount retention ring length, each of the longitudinal grooves configured to allow a lug of the plurality of lugs to pass therethrough, a plurality of circumferential grooves, each of the plurality of circumferential grooves located in the interior wall at the forward end of a longitudinal groove and extending partially about the mount retention ring circumference, each of the plurality of circumferential grooves configured to receive a lug from a longitudinal groove and having a circumferential groove rear side defined by a rear ledge located in the interior wall, a circumferential groove forward side defined by a forward ledge in the interior wall, the forward ledge located forwardly relative to the rear ledge in the mount retention ring interior, a circumferential groove thickness extending from the circumferential groove forward side to the circumferential groove rear side, a circumferential groove first radial side located adjacent to a longitudinal groove, a circumferential groove second radial side opposite the first radial side, a circumferential groove length extending from the first radial side to the second radial side and generally parallel to the mount retention ring circumference and generally perpendicular to the longitudinal groove lengths, a plurality of indentations, each indentation located in a rear ledge adjacent to a second radial side of a circumferential groove and extending toward the mount retention ring rear end, and a plurality of mount retention ring threads spaced about the exterior of the mount retention ring; and d) a silencer barrel comprising a silencer barrel interior comprising the mount retention ring, a silencer barrel exterior wall, a silencer barrel front end comprising a silencer barrel forward opening leading to the silencer barrel interior and configured to fire the ammunition, a silencer barrel rear end comprising a silencer barrel rear opening leading to the silencer barrel interior, a silencer barrel length extending from the silencer barrel front end to the silencer barrel rear end, and a plurality of silencer barrel threads located in the silencer barrel interior and mating with the mount retention ring threads, wherein, when the ammunition is fired from the firearm, the ammunition is configured to pass from the gun barrel, through the muzzle break interior, through the mount retention ring interior, and out the silencer barrel forward opening, and the silencer barrel interior is configured to dampen noise emanating from the firearm suppressor system, wherein the silencer barrel comprises a longitudinal axis parallel to the silencer barrel length and passing through the silencer barrel interior, wherein rotating the silencer barrel exterior wall a first rotation about the longitudinal axis relative to the muzzle break and the gun barrel when each lug is located in a circumferential groove and adjacent to the first radial side and adjacent to a rear ledge is configured to rotate the mount retention ring so that each second radial side moves toward and contacts a lug, and further wherein rotating the silencer barrel exterior wall a second rotation in the same direction as the first rotation about the longitudinal axis relative to the muzzle break and the gun barrel when each lug is located in a circumferential groove and contacting the second radial side is configured to move the mount retention ring threads about the silencer barrel threads and to move the mount retention ring longitudinally within the silencer barrel interior toward the silencer barrel front end so that each indentation approaches one of the lugs;

wherein the system further comprises at least one retention spring exerting tension on the mount retention ring in the rear direction; and wherein the at least one retention spring comprises a forward end connected to a ledge within the silencer barrel interior and a rear end connected to a forward end of a pin, and further wherein the pin further comprises a rear end connected to the mount retention ring forward end.

2. The firearm suppressor system of claim 1, wherein the mount retention ring threads are not configured to move about the silencer barrel threads during the first rotation and the mount retention ring is configured to remain a fixed distance from the silencer barrel front end during the first rotation.

3. The firearm suppressor system of claim 1 wherein the spacing between the lugs along the muzzle break circumference is substantially equal to the spacing between the longitudinal grooves about the mount retention ring circumference.

4. The firearm suppressor system of claim 1, wherein the forward end of the pin is attached to a forward end of a ratchet retention ring, and further wherein the ratchet retention ring comprises a rear end comprising a plurality of teeth spaced about the ratchet retention ring and configured to mate with a plurality of forward end grooves spaced about a forward face of the mount retention ring forward end, each of the plurality of forward end grooves separated by a ridge.

5. The firearm suppressor system of claim 1, wherein the silencer barrel interior comprises a plurality of baffles forwardly disposed relative to the silencer barrel threads.

6. The firearm suppressor system of claim 1 wherein the muzzle break comprises a tapered portion located forwardly relative to the lugs and configured to contact a tapered portion of an interior wall of the silencer barrel when the plurality of lugs are located in the plurality of circumferential grooves and further wherein the contact between the tapered portion of the muzzle break and the tapered portion of the interior wall is configured to prevent the muzzle break from moving toward the silencer barrel front end.

7. The firearm suppressor system of claim 1, wherein the silencer barrel is configured to be locked to the muzzle break with a user using one hand to rotate the silencer barrel exterior wall.

8. The firearm suppressor system of claim 1, wherein all components for attaching the muzzle break to the silencer barrel are located in the silencer barrel interior when the silencer barrel is locked to the muzzle break.

9. The firearm suppressor system of claim 1, wherein the silencer barrel further comprises a tube locking ring comprising tube locking ring threads mating with the silencer barrel threads, the tube locking ring forming the rear end of the silencer barrel and configured to prevent the mount retention ring threads from moving rearwardly beyond the silencer barrel threads, a taper mount cap comprising the silencer barrel threads, and a sleeve forming the forward end of the silencer barrel.

10. The firearm suppressor system of claim 1, wherein the muzzle break further comprises a plurality of gas ports configured to reduce flash and further wherein the lugs are located rearwardly relative to the gas ports.

11. The firearm suppressor system of claim 1, wherein the lugs are generally pyramidal in shape.

12. The firearm suppressor system of claim 1, wherein the circumferential grooves are generally perpendicular to the longitudinal grooves.

13. A method of mating a suppressor to a firearm, the method comprising the steps of:

a) providing the system of claim 1;

b) inserting the lugs through the longitudinal grooves and into the circumferential grooves adjacent to the circumferential groove first radial ends;

c) rotating the silencer barrel exterior wall the first rotation relative to the muzzle break so that the lugs move towards and contact the circumferential groove second radial ends; and d) rotating the silencer barrel exterior wall the second rotation relative to the muzzle break so that the lugs cause the mount retention ring threads to move along the silencer barrel threads and cause the mount retention ring to move forwardly within the barrel sleeve interior so that the indentations move forwardly within the silencer barrel interior toward the lugs.

14. A firearm suppressor system comprising:

a) a firearm comprising a gun barrel configured to fire ammunition;

b) a muzzle break attached to the gun barrel and comprising a muzzle break interior receiving the gun barrel, a muzzle break rear end facing the firearm and comprising a muzzle break rear opening leading to the muzzle break interior, a muzzle break forward end comprising a muzzle break forward opening leading to the muzzle break interior and configured to eject the ammunition, a muzzle break length extending from the muzzle break forward end to the muzzle break rear end, a muzzle break width perpendicular to the muzzle break length, and a muzzle break circumference perpendicular to the muzzle break length; and c) a silencer barrel configured to removably lock to the muzzle break and comprising a silencer barrel interior comprising a mount retention ring, a silencer barrel front end comprising a silencer barrel forward opening leading to the silencer barrel interior and configured to fire the ammunition, a silencer barrel rear end comprising a silencer barrel rear opening leading to the silencer barrel interior, a silencer barrel length extending from the silencer barrel front end to the silencer barrel rear end, and a longitudinal axis parallel to the silencer barrel length and passing through the silencer barrel interior, the silencer barrel comprised of:

i) a tube locking ring forming the rear end of the silencer barrel and having a tube locking ring rear end comprising the silencer barrel rear opening and a tube locking ring forward end comprising a plurality of tube locking ring threads;

ii) the mount retention ring comprising a circumference and at least one lock configured to removably lock to the muzzle break, the mount retention ring comprising a forward end comprising a plurality of mount retention ring threads disposed forwardly within the silencer barrel interior relative to the tube locking ring threads and a plurality of grooves spaced about a forward face of the forward end of the mount retention ring;

iii) a ratchet retention ring comprising a forward end facing the forward end of the silencer barrel and a rear end facing the plurality of grooves and comprising a plurality of teeth configured to mate with the plurality of grooves;

iv) a taper mount cap disposed forwardly relative to the tube locking ring, the taper mount cap comprising an interior comprising the mount retention ring, the ratchet retention ring, a taper mount cap ledge disposed forwardly relative to the mount retention ring and the ratchet retention ring within the taper mount cap interior and a plurality of taper mount cap threads configured to mate with the tube locking ring threads and the mount retention ring threads, the taper mount cap ledge comprising a taper mount cap ledge circumference and a plurality of spring recesses spaced about the taper mount cap ledge circumference;

v) a plurality of retention springs seated inside the plurality of spring recesses, each spring having a forward end and a rear end; and vi) a plurality of retention pins located at least partially in the spring recesses, each retention pin having a forward end attached to a rear end of a retention spring and a rear end attached to the ratchet retention ring, wherein the taper mount cap, the ratchet retention ring and the tube locking ring are rotatable along a silencer barrel longitudinal axis relative to the mount retention ring, wherein rotation of the taper mount cap, the ratchet retention ring and the tube locking ring relative to the mount retention ring causes the mount retention ring to move along the taper mount cap threads and the silencer barrel length and causes the teeth to move about the mount retention ring grooves, wherein the retention pins exert tension on the ratchet retention ring in the rear direction, wherein, when the ammunition is fired from the firearm, the ammunition is configured to pass from the gun barrel, through the muzzle break interior, through the tube locking ring, through the taper mount cap interior and out the silencer barrel forward opening, and the silencer barrel interior is configured to dampen noise emanating from the firearm suppressor system.

15. The firearm suppressor system of claim 14 wherein the mount retention ring lock comprises at least one mount retention ring groove located in the mount retention ring interior and configured to mate with a muzzle break lug located on the muzzle break.

16. The firearm suppressor system of claim 15 wherein the at least one groove comprises at least one longitudinal groove extending partially about the mount retention groove length and at least one circumferential groove connected to the at least one longitudinal groove and extending partially about the mount retention groove circumference.

17. The firearm suppressor system of claim 14 wherein the silencer barrel interior comprises a plurality of baffles disposed forwardly relative to the taper mount cap.

18. The firearm suppressor system of claim 14 wherein rotation of the taper mount cap, the ratchet retention ring and the tube locking ring relative to the mount retention ring causes the mount retention ring to move along the taper mount cap threads and to move forwardly the silencer barrel length.

* * * * *